US011369140B2

(12) United States Patent
Liu et al.

(10) Patent No.: US 11,369,140 B2
(45) Date of Patent: Jun. 28, 2022

(54) ULTRASONIC ELECTRONIC CIGARETTE ATOMIZER WITH LIQUID LEAKAGE PREVENTION

(71) Applicant: CHINA TOBACCO HUNAN INDUSTRIAL CO., LTD., Hunan (CN)

(72) Inventors: Jianfu Liu, Hunan (CN); Kejun Zhong, Hunan (CN); Xiaoyi Guo, Hunan (CN); Wei Huang, Hunan (CN); Hong Yu, Hunan (CN); Yuangang Dai, Hunan (CN); Xinqiang Yin, Hunan (CN); Jianhua Yi, Hunan (CN); Lizhou Shen, Hunan (CN)

(73) Assignee: CHINA TOBACCO HUNAN INDUSTRIAL CO., LTD., Hunan (CN)

( * ) Notice: Subject to any disclaimer, the term of this patent is extended or adjusted under 35 U.S.C. 154(b) by 385 days.

(21) Appl. No.: 16/500,640

(22) PCT Filed: Apr. 13, 2018

(86) PCT No.: PCT/CN2018/082911
§ 371 (c)(1),
(2) Date: Oct. 3, 2019

(87) PCT Pub. No.: WO2018/188640
PCT Pub. Date: Oct. 18, 2018

(65) Prior Publication Data

US 2020/0107577 A1 Apr. 9, 2020

(30) Foreign Application Priority Data

Apr. 13, 2017 (CN) ..... 201710239886.9
Apr. 13, 2017 (CN) ..... 201720385996.1
Apr. 13, 2017 (CN) ..... 201720385999.5

(51) Int. Cl.
*A24F 40/40* (2020.01)
*A24F 40/48* (2020.01)
(Continued)

(52) U.S. Cl.
CPC ..... *A24F 40/40* (2020.01); *A24F 40/05* (2020.01); *A24F 40/44* (2020.01); *A24F 40/48* (2020.01);
(Continued)

(58) Field of Classification Search
CPC ..... A24F 40/00; A24F 40/40; A24F 40/48; A24F 40/485
See application file for complete search history.

(56) References Cited

U.S. PATENT DOCUMENTS

2019/0373953 A1* 12/2019 Atkins ..... A24F 40/46
2020/0060336 A1* 2/2020 Liu ..... A24F 40/40
(Continued)

FOREIGN PATENT DOCUMENTS

CN 103380952 A 11/2013
CN 205196999 U 5/2016
(Continued)

OTHER PUBLICATIONS

International Search Report issued in International Application No. PCT/CN2018/082911 dated Jul. 6, 2018, 5 pages.

*Primary Examiner* — Hae Moon Hyeon
(74) *Attorney, Agent, or Firm* — Mauriel Kapouytian Woods LLP; Tzvi Hirshaut; Michael Mauriel

(57) ABSTRACT

An ultrasonic electronic cigarette atomizer is disclosed, including an atomization core, an atomizer housing, and a liquid bin. When liquid is filled into the liquid bin, the liquid passing hole is closed and the air outlet channel is closed, to avoid leakage or immersion of liquid, the atomizer is clean and sanitary, waste is avoided, and cost is saved. The whole
(Continued)

operation is very simple, the atomization core is convenient to replace, hands are not stained with liquid, and the liquid is convenient to fill. The cigarette liquid is unlikely to flow out through the liquid filling hole, and large granular cigarette liquid generated in atomization can be recycled.

19 Claims, 15 Drawing Sheets

(51) Int. Cl.

| | |
|---|---|
| ***A24F 40/44*** | (2020.01) |
| ***A24F 40/05*** | (2020.01) |
| ***A24F 40/50*** | (2020.01) |
| ***B05B 17/06*** | (2006.01) |
| ***A24F 40/485*** | (2020.01) |
| *A24F 40/10* | (2020.01) |

(52) U.S. Cl.
CPC ..... *A24F 40/485* (2020.01); *A24F 40/50* (2020.01); *B05B 17/0684* (2013.01); *A24F 40/10* (2020.01)

(56) References Cited

U.S. PATENT DOCUMENTS

| | | | | |
|---|---|---|---|---|
| 2020/0128874 | A1* | 4/2020 | Atkins | A24F 40/44 |
| 2021/0112858 | A1* | 4/2021 | Liu | A24F 40/44 |

FOREIGN PATENT DOCUMENTS

| | | | |
|---|---|---|---|
| CN | 205813571 | U | 12/2016 |
| CN | 206025225 | U | 3/2017 |
| CN | 206025226 | U | 3/2017 |
| CN | 206687171 | U | 12/2017 |
| CN | 206687172 | U | 12/2017 |
| WO | 2016141592 | A1 | 9/2016 |

* cited by examiner

ULTRASONIC ELECTRONIC CIGARETTE ATOMIZER WITH LIQUID LEAKAGE PREVENTION

CROSS REFERENCE TO RELATED APPLICATIONS

This application is a national phase application of international application number PCT/CN2018/082911 filed on Apr. 13, 2018, which claims priority to Chinese application number 201710239886.9 filed on Apr. 13, 2017, Chinese application number 201720385996.1 filed on Apr. 13, 2017, and Chinese application number 201720385999.5 filed on Apr. 13, 2017. The entire contents of these applications are hereby incorporated herein by reference.

FIELD OF THE INVENTION

The present invention belongs to the technical field of electronic cigarettes, and particularly relates to an ultrasonic electronic cigarette atomizer.

BACKGROUND OF THE INVENTION

The conventional ultrasonic electronic cigarette atomizer has the following disadvantages:

First, when liquid is filled into a liquid bin in an atomizer housing, since a liquid passing hole for connecting the liquid bin with an ultrasonic atomization sheet is not closed, the cigarette liquid in the liquid bin is squeezed out from the liquid passing hole due to the pressure in the liquid bin, resulting in liquid leakage or liquid immersion of the ultrasonic atomization sheet.

Second, when filling the liquid, since an air outlet channel is not cut off, liquid leakage is likely to occur when sucking the electronic cigarette with opened liquid filling hole.

Third, the atomization cores are all disposed inside the atomizer housing, when replacing the atomization core, hands of an operator performing replacement are easily stained with cigarette liquid, and multiple disassembly operations are required to replace the atomization core.

Fourth, the conventional ultrasonic electronic cigarette atomizer is filled with liquid from the bottom or the top. When filling the liquid, a bottom or top cover needs to be unscrewed manually, only then liquid can be filled into the liquid bin through the liquid filling hole, and the bottom or top cover needs to be screwed manually after liquid filling, so the liquid filling operation is very troublesome.

Fifth, after the bottom or top cover is unscrewed, the liquid filling hole of the liquid bin is exposed, and the cigarette liquid in the liquid bin easily flows out through the liquid filling hole, causing waste and pollution.

Sixth, the atomization core of the conventional ultrasonic electronic cigarette comprises an ultrasonic atomization sheet and a liquid guide structure for guiding cigarette liquid to the surface of the ultrasonic atomization sheet for atomization. When the ultrasonic atomization sheet operates for atomization, the atomization region of the atomization sheet sprays large granular cigarette liquid outward perpendicular to the atomization sheet. Since the atomization core of the conventional high-frequency ultrasonic electronic cigarette does not recycle the large granular cigarette liquid generated in atomization, the air channel is easily blocked by the large granular cigarette liquid, the user easily sucks the cigarette liquid, the ultrasonic atomization sheet is easily immersed in the liquid, the liquid easily leaks from the atomization core, and the cigarette liquid have low utilization and high consumption.

SUMMARY OF THE INVENTION

When the conventional ultrasonic electronic cigarette atomizer is filled with liquid, the liquid passing hole is not closed, and the air outlet channel is not closed, so that liquid leakage or immersion of liquid is likely to occur; at the same time, the disassembly and assembly of the atomization core are troublesome, the liquid filling operation is troublesome, hands are easily stained with cigarette liquid when replacing, and the cigarette liquid easily flows out through the liquid filling hole; the atomization core does not recycle large granular cigarette liquid, the air channel is easily blocked by the large granular cigarette liquid, the user easily sucks the cigarette liquid, the ultrasonic atomization sheet is easily immersed in the liquid, the liquid easily leaks from the atomization core, and the cigarette liquid have low utilization and high consumption. The present invention is directed to provide an ultrasonic electronic cigarette atomizer against the above deficiencies of the prior art, where when liquid is filled into the liquid bin, the liquid passing hole is closed and the air outlet channel is closed, so that the atomization core is convenient to replace, the liquid is convenient to fill, hands will not stained with liquid when the atomization core is replaced, the cigarette liquid is unlikely to flow out through the liquid filling hole, the atomizer is clean and sanitary, and waste is avoided; the large granular cigarette liquid generated in atomization can be recycled, the air channel is unlikely to block, the user does not suck the cigarette liquid, the ultrasonic atomization sheet is not immersed in the liquid, the liquid is unlikely to leak from the atomization core, and the cigarette liquid has high utilization and low consumption.

In order to solve the above technical problems, the technical solution adopted by the present invention is as follows:

An ultrasonic electronic cigarette atomizer comprises an atomization core, an atomizer housing, and a liquid bin in the atomizer housing, the atomization core including an ultrasonic atomization sheet and a liquid guide structure connected to the ultrasonic atomization sheet, the liquid guide structure and the inner cavity of the liquid bin are communicated through a liquid passing hole which disposed on the side wall of the liquid bin, the liquid bin is provided with a first liquid filling hole, wherein the atomizer further comprises a liquid filling control structure for controlling the opening and closing of the first liquid filling hole and a liquid passing control structure for controlling the opening and closing of the liquid passing hole, and the liquid filling control structure is linked with the liquid passing control structure; when the first liquid filling hole is opened under the control of the liquid filling control structure, the liquid passing hole is closed under the control of the liquid passing control structure; when the first liquid filling hole is closed under the control of the liquid filling control structure, the liquid passing hole is opened under the control of the liquid passing control structure.

With the above structure, the opening and closing of the liquid passing hole are linked with the opening and closing of the first liquid filling hole, so the operation is simple and the user experience is good. When filling liquid, the liquid passing hole is closed to avoid the increasing pressure in the liquid bin squeeze the cigarette liquid out from the liquid passing hole when filling the liquid into the liquid bin, thereby avoiding liquid leakage or liquid immersion of the ultrasonic atomization sheet.

Further, the ultrasonic electronic cigarette atomizer further comprises an air outlet control structure for controlling the opening and closing of an air outlet channel of the atomizer, wherein the air outlet control structure is linked with the liquid passing control structure; when the first liquid filling hole is opened under the control of the liquid filling control structure, the air outlet channel is closed under the control of the air outlet control structure; when the first liquid filling hole is closed under the control of the liquid filling control structure, the air outlet channel is opened under the control of the air outlet control structure.

With the above structure, the opening and closing of the air outlet channel are linked with the opening and closing of the first liquid filling hole, so the operation is simple and the user experience is good. When filling the liquid, the air outlet channel is closed to prevent the user from sucking the electronic cigarette without closing the first liquid filling hole, thereby reducing the risk of liquid leakage.

Further, the atomization core comprises anatomization core housing, the ultrasonic atomization sheet and the liquid guide structure are both fixed inside the atomization core housing, the atomization core extends into the atomizer housing from one side of the atomizer housing, and the atomization core housing is exposed.

With the above structure, since the atomization core housing is exposed, when replacing the atomization core, hands of an operator performing replacement will not stained with cigarette liquid, and are clean and sanitary.

Further, the ultrasonic electronic cigarette atomizer comprises a locking structure capable of locking and fixing the atomization core; when the first liquid filling hole is opened under the control of the liquid filling control structure, the atomization core is unlocked under the control of the locking structure; when the first liquid filling hole is closed under the control of the liquid filling control structure, the atomization core is locked and fixed under the control of the locking structure.

With the above structure, the locking or unlocking of the atomization core is linked with the opening and closing of the first liquid filling hole, and the user can complete the linkage of locking or unlocking of the atomization core by only one operation, simple operation, strong practicability, and good user experience. The atomization core is locked by the locking structure, so that the atomization core is unlikely to drop out. The atomization core can be replaced after unlocking the locking structure, so the operation is convenient. In the state of use, the atomization core can be locked to prevent the atomization core from dropping out due to various reasons (unintentional pull-out or vibration) during the use of the electronic cigarette to cause leakage of the cigarette liquid.

As a preferred manner, the liquid filling control structure comprises a fixed plate which disposed in the atomizer housing and fixed on the liquid bin, and a slider capable of moves along the length of the fixed plate; the fixed plate is provided with a second liquid filling hole opposite to the first liquid filling hole, and the slider is provided with a third liquid filling hole; when the slider slides along the fixed plate, the third liquid filling hole can be aligned or staggered with the first liquid filling hole.

With the above structure, the liquid filling hole is opened or closed by sliding, so the structure is simple, the sealing property is good, and the operation is convenient.

As a preferred manner, the liquid passing control structure comprises a fixed plate fixed on the liquid bin in the atomizer housing, a slider capable of moves along the length of the fixed plate, and a rotating shaft; a receiving groove whose axis is perpendicular to the axis of the liquid passing hole is formed in the liquid bin, and the receiving groove is communicated with the liquid passing hole; the rotating shaft is located in the receiving groove, and a liquid retaining plate is disposed at a position of the rotating shaft corresponding to the liquid passing hole; the slider is connected with the rotating shaft in a transmission way, the slider can drive the rotating shaft to rotate until the liquid retaining plate is perpendicular to the axis of the liquid passing hole and closes the liquid passing hole, and the slider can also drive the rotating shaft to rotate until the liquid retaining plate is parallel to the axis of the liquid passing hole and opens the liquid passing hole.

With the above structure, the liquid passing hole can be opened and closed by rotating the rotating shaft.

As a preferred manner, the slider is provided with a rack along the length of the said slider, and a gear engaging with the rack is disposed on the rotating shaft.

With the above structure, based on the principle of gear-rack transmission, when the first liquid filling hole is opened (e.g., the slider moves to the left), the slider drives the rotating shaft to rotate 90°, so that the liquid retaining plate is perpendicular to the axis of the liquid passing hole, and the liquid retaining plate closes the liquid passing hole; when the first liquid filling hole is closed (e.g., the slider moves to the right), the slider drives the rotating shaft to rotate 90° in the opposite direction, so that the liquid retaining plate is parallel to the axis of the liquid passing hole, and the liquid retaining plate does not block the liquid passing hole to link the opening and closing of the liquid passing hole.

As another preferred manner, the liquid passing control structure comprises a fixed plate fixed which disposed in the atomizer housing and fixed on the liquid bin, a slider capable of moves along the length of the fixed plate, and a sliding shaft; a receiving groove whose axis is perpendicular to the axis of the liquid passing hole is formed in the liquid bin, and the receiving groove is communicated with the liquid passing hole; the sliding shaft is located in the receiving groove; the slider is connected with the sliding shaft in a transmission way, and the slider can drive the sliding shaft to slide up and down along the receiving groove and to open or close the liquid passing hole. With the above structure, the liquid passing hole can be opened and closed by up-down sliding of the sliding shaft, and the sealing effect is better when the liquid passing hole is closed.

As a preferred manner, the bottom of the slider is provided with a first bevel, the top of the sliding shaft is provided with a second bevel corresponding to the first bevel, the external of the sliding shaft is sleeved with a return spring, the sliding shaft is provided with a limiting portion, the bottom end of the return spring is supported on a step of the inner side wall of the receiving groove, and the top end of the return spring abuts against the limiting portion.

With the above structure, the bevel acts on the sliding shaft in the sliding process of the slider, and the sliding shaft can move up and down in a very labor-saving manner, thereby controlling the opening and closing of the liquid passing hole.

Further, a vertical guiding groove is formed in the inner side wall of the receiving groove, and the sliding shaft is provided with a guiding salient point matching the vertical guiding groove.

The guiding groove corresponds to the guiding salient point, and the up-down sliding of the sliding shaft not only can play a guiding role, but also can avoid rotation, so that the sliding shaft controls the opening and closing of the liquid passing hole better and more accurately, and the operation is more reliable.

As a preferred manner, the air outlet control structure comprises a fixed plate which disposed in the atomizer housing and fixed on the liquid bin, and a slider capable of moves along the length of the fixed plate; the slider is provided with an air passing hole; when the slider slides along the fixed plate, the slider drives the air passing hole to open or close the air outlet channel.

The slider is provided with an air passing hole, which can be aligned or staggered with the air outlet channel by reciprocating motion of the slider, so that the air outlet channel is closed or opened. In the state of use, the air passing hole opens the air outlet channel, the entire air channel is opened, and the user can smoke normally; when liquid is filled, the air passing hole closes the air outlet channel, the entire air channel is closed, and the user can not smoke As a preferred manner, the locking structure comprises a fixed plate which disposed in the atomizer housing and fixed on the liquid bin, a slider capable of moves along the length of the fixed plate, and a ball-head pin capable of moves up and down along a through hole of the fixed plate; the external of the ball-head pin is sleeved with a reset spring, and the bottom of the reset spring is supported on the inner side wall of the through hole; the bottom of the slider is provided with a bevel of the slider corresponding to the head of the ball-head pin, and the atomization core is provided with a locking hole corresponding to the pin.

When the slider is pushed to open the first liquid filling hole, the slider is linked with the rotating shaft to rotate so that the liquid retaining plate seals the liquid passing hole, the slider is also linked with the atomization core for unlocking, and the atomization core can be pulled out for replacement to prevent liquid leakage.

The contact portion between the bottom surface of the slider and the pin is of a bevel structure. When the slider reciprocates, the ball-head pin can be driven to move up and down to unlock and lock the atomization core. In the state of use, the slider abuts against the head of the pin, and the pin is inserted into the locking hole of the atomization core to lock the atomization core; when the first liquid filling hole is opened, the slider leaves the top of the pin, and the pin moves upward under the effect of the reset spring and exits the locking hole of the atomization core to unlock the atomization core.

Further, the atomization core housing is provided with a hand-held portion.

With the hand-held portion, the atomization core is more convenient to replace.

Further, a silicone pad is disposed in the second liquid filling hole, the silicone pad is provided with raised ribs on the side facing the slider, and the center of the silicone pad is provided with a fourth liquid filling hole opposite to the second liquid filling hole.

When liquid is not filled, the slider presses the raised ribs of the silicone pad to seal the cigarette liquid, and avoid excessive resistance caused by large-area squeeze sealing method when the slider is opened.

Further, an elastic sheet is disposed in the fourth liquid filling hole, and the elastic sheet is unilaterally connected to the silicone pad.

The elastic sheet is unilaterally connected to the silicone pad, a liquid filling nozzle is pressed down to open the elastic sheet for filling liquid, and the elastic sheet is restored to the initial position after the liquid is filled, so that the cigarette liquid can be prevented from being thrown out by shaking the cigarette when the first liquid filling hole is not closed.

Further, a silicone ring is disposed between the liquid bin and the fixed plate.

The silicone ring is used for seal the cigarette liquid.

As a preferred manner, the atomization core comprises an atomization seat, an atomization sleeve, and an atomization cover; the atomization sleeve is fixed between the atomization cover and the atomization core housing; the ultrasonic atomization sheet is fixed in the atomization seat and the ultrasonic atomization sheet is parallel to the length direction of the electronic cigarette, the atomization seat is sleeved in the atomization sleeve, the liquid guide structure comprises liquid storage cotton and a U-shaped liquid guide cotton sheet, the liquid storage cotton is fixed in the atomization sleeve, two opposite sides of the U-shaped liquid guide cotton sheet pass through the atomization sleeve and are connected with the liquid storage cotton, and the outside of a third side of the U-shaped liquid guide cotton sheet abuts against the ultrasonic atomization sheet; the liquid storage cotton is communicated with the liquid bin through the liquid passing hole; the atomization sleeve is provided with an air passing groove for connecting the inside of the third side of the U-shaped liquid guide cotton sheet with an air inlet and a nozzle sleeve on the atomizer.

Further, the atomization core further comprises a cotton pressing spring, one end of the cotton pressing spring abuts against the inside of the third side of the U-shaped liquid guide cotton sheet, and the other end of the cotton pressing spring abuts against the inner wall of the atomization seat.

With the above structure, deformation of the U-shaped liquid guide cotton sheet can be prevented, meanwhile, since the top end of the cotton pressing spring does not directly abut against the liquid storage cotton, the liquid storage cotton can be prevented from being separated from the atomization sleeve as well.

Further, the inside of the third side of the U-shaped liquid guide cotton sheet is communicated with the liquid storage cotton through a cigarette liquid recycling hole on the atomization seat.

With the above structure, the liquid storage cotton can temporarily store some cigarette liquid, which makes the liquid supply more stable. The liquid storage cotton guides the cigarette liquid in the liquid bin to the surface of the ultrasonic atomization sheet through the U-shaped liquid guide cotton sheet for ultrasonic atomization, and large granular cigarette liquid generated during atomization is directly sprayed onto the liquid storage cotton and absorbed by the liquid storage cotton, and guided to the surface of the ultrasonic atomization sheet through the U-shaped liquid guide cotton sheet again for ultrasonic atomization, so that the cigarette liquid is recycled.

Further, a positive electrode ring and a negative electrode ring are embedded into the atomization cover; one side of the ultrasonic atomization sheet is attached to one end of a positive elastic sheet, and the other end of the positive elastic sheet is locked with the positive electrode ring by a positive screw; the other side of the ultrasonic atomization sheet is attached to one end of a negative elastic sheet, and the other end of the negative elastic sheet is locked with the negative electrode ring by a negative screw; a positive elastic electrode attached to the positive electrode ring and a negative elastic electrode attached to the negative electrode ring are arranged in the atomizer housing.

With the above structure, positive and negative silver layers of the ultrasonic atomization sheet are selectively attached to each other by means of the positive elastic sheet and the negative elastic sheet to conduct electricity, the positive and negative elastic sheets are respectively locked to the positive and negative electrode rings by means of the positive and negative screws for fixing and electric conduction. The entire ultrasonic atomization sheet does not need solder wires for electric conduction, convenient to assemble and can also avoid ultrasonic atomization sheet depolarization due to over-heated solder wires; meanwhile, the ultrasonic atomization sheet is not plated with tin, which can avoid pollution to the cigarette liquid and is more environment-friendly and sanitary. After the atomization core is assembled into the atomizer, the electric circuit is conducted directly by contact between the elastic electrodes and the electrode rings, so the disassembly and assembly are convenient, and the operation is reliable.

Further, a cigarette liquid recycling groove is formed between an atomization region of the ultrasonic atomization sheet and the liquid guide structure.

With the above structure, large granular smoke generated by the ultrasonic atomization sheet during atomization can be directly sprayed onto the liquid guide structure through the cigarette liquid recycling groove, absorbed by the liquid guide structure, and further guided back to the surface of the ultrasonic atomization sheet for secondary utilization. Hence, since the present invention recycled the large granular smoke generated during atomization, the user will not suck the cigarette liquid, the ultrasonic atomized sheet is not immersed in the liquid, the liquid is unlikely to leak from the atomization core, and the cigarette liquid has high utilization and low consumption.

As a preferred manner, the atomization core comprises an atomization seat and an atomization sleeve, the ultrasonic atomization sheet is fixed in the atomization seat, the atomization seat is sleeved in the atomization sleeve, the liquid guide structure comprises a porous liquid guide body, the porous liquid guide body is embedded in the atomization seat, the outer end face of the porous liquid guide body is communicated with the liquid bin of the electronic cigarette, and the inner end face of the porous liquid guide body abuts against the ultrasonic atomization sheet; the cigarette liquid recycling groove is formed in the inner end face of the porous liquid guide body.

With the above structure, a single liquid guide body made of a porous material is provided to guide the cigarette liquid in the liquid bin to the surface of the ultrasonic atomization sheet for ultrasonic atomization. The large granular smoke generated during atomization is directly sprayed onto the porous liquid guide body through the cigarette liquid recycling groove, and absorbed by the porous liquid guide body, and be guided again to the surface of the ultrasonic atomization sheet for ultrasonic atomization, so that the cigarette liquid is recycled. By providing a single porous liquid guide body, the structure is simpler, the operation is more reliable, and the cost is lower.

In addition to the recycling of the cigarette liquid, the cigarette liquid recycling groove is also used for air passing. An air passing channel is formed between the cigarette liquid recycling groove and the air passing groove to carry out the smoke generated during atomization. Air passes through the cigarette liquid recycling groove inside the porous liquid guide body, so that the smoke can be carried out more thoroughly. The width of the air passing groove is preferably 0.5 to 5 mm. The air passing channel should be close to the atomization region as much as possible to take away the smoke thoroughly. If the air passing groove is too narrow, enough smoke can be sucked with great effort, and the cigarette liquid is easily sucked; if the air passing groove is too large, the concentration of smoke is relatively small. The width of the air passing groove is 0.5 to 5 mm, so that the quantity and concentration of smoke are moderate, which meets the requirements of smoking.

As another preferred manner, the atomization core comprises an atomization seat, an atomization core inner sleeve, an atomization core outer sleeve, and an atomization cover; the ultrasonic atomization sheet is fixed in the atomization seat and is perpendicular to the length direction of the electronic cigarette, the atomization seat is fixed in the bottom end of the atomization core outer sleeve, the liquid guide structure comprises liquid storage cotton and cup-shaped liquid guide cotton, the liquid storage cotton is fixed in the atomization core outer sleeve, the side wall of the cup-shaped liquid guide cotton is sandwiched between the atomization core outer sleeve and the atomization core inner sleeve, and the side wall of the cup-shaped liquid guide cotton is connected to the liquid storage cotton, the bottom of the cup-shaped liquid guide cotton abuts against the ultrasonic atomization sheet; the liquid storage cotton is communicated with the liquid bin; the atomization core inner sleeve and the atomization core outer sleeve are fixed between the atomization cover and the atomization core housing; the atomization cover is provided with an air passing groove for connecting the inside of the cup-shaped liquid guide cotton with an air inlet and a nozzle sleeve on the atomizer.

As a preferred manner, the locking structure is a pin locking structure, and the atomization cover is provided with a locking hole corresponding to the pin locking structure.

By unlocking the pin locking structure, the atomization core can be unlocked and replaced, which is very convenient to operate.

Compared with the prior art, the present invention has the advantages that the opening and closing of the liquid passing hole, the opening and closing of the air outlet channel, and the unlocking and locking of the atomization core can all be controlled by means of the opening and closing of the liquid filling hole in a linked manner to form a four-linkage mechanism; when filling liquid into the liquid bin, the liquid passing hole is closed and the air outlet channel is closed, so that leakage or immersion of liquid can be avoided, the atomizer is clean and sanitary, waste is avoided, and the cost is saved; the whole operation is very simple, the atomization core is convenient to replace, hands are not stained with liquid, the liquid is convenient to fill, multiple operations can be completed by only one operation, and the user experience of a customer is greatly improved; the cigarette liquid is unlikely to flow out through the liquid filling hole, the atomizer is clean and sanitary, and waste is avoided; and large granular cigarette liquid generated during atomization can be recycled, so that the air channel is unlikely to be blocked, the user does not suck the cigarette liquid, and the cigarette liquid has high utilization and low consumption.

Figure 1:
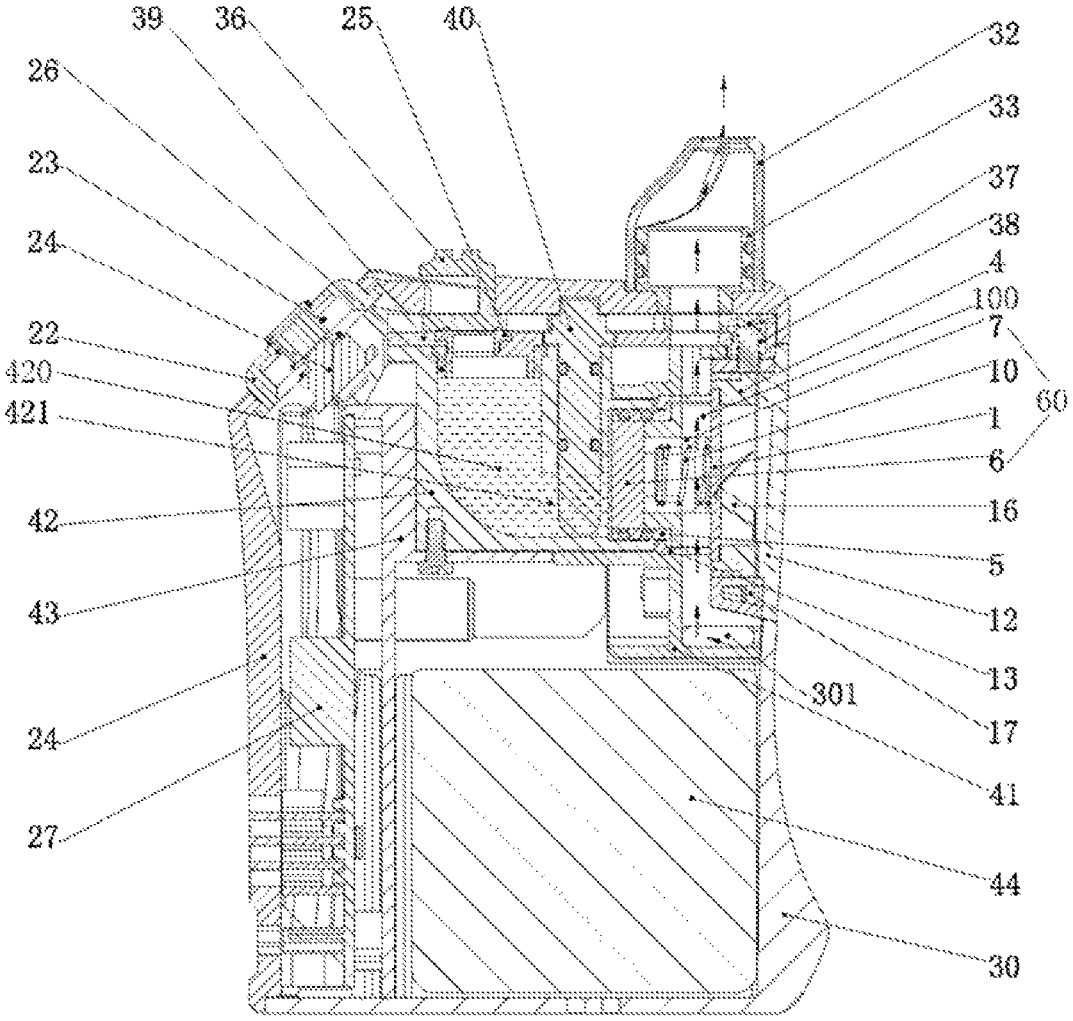
FIG. 1 is a front cross-sectional view of Embodiment 1 of an atomizer.
Figure 2:
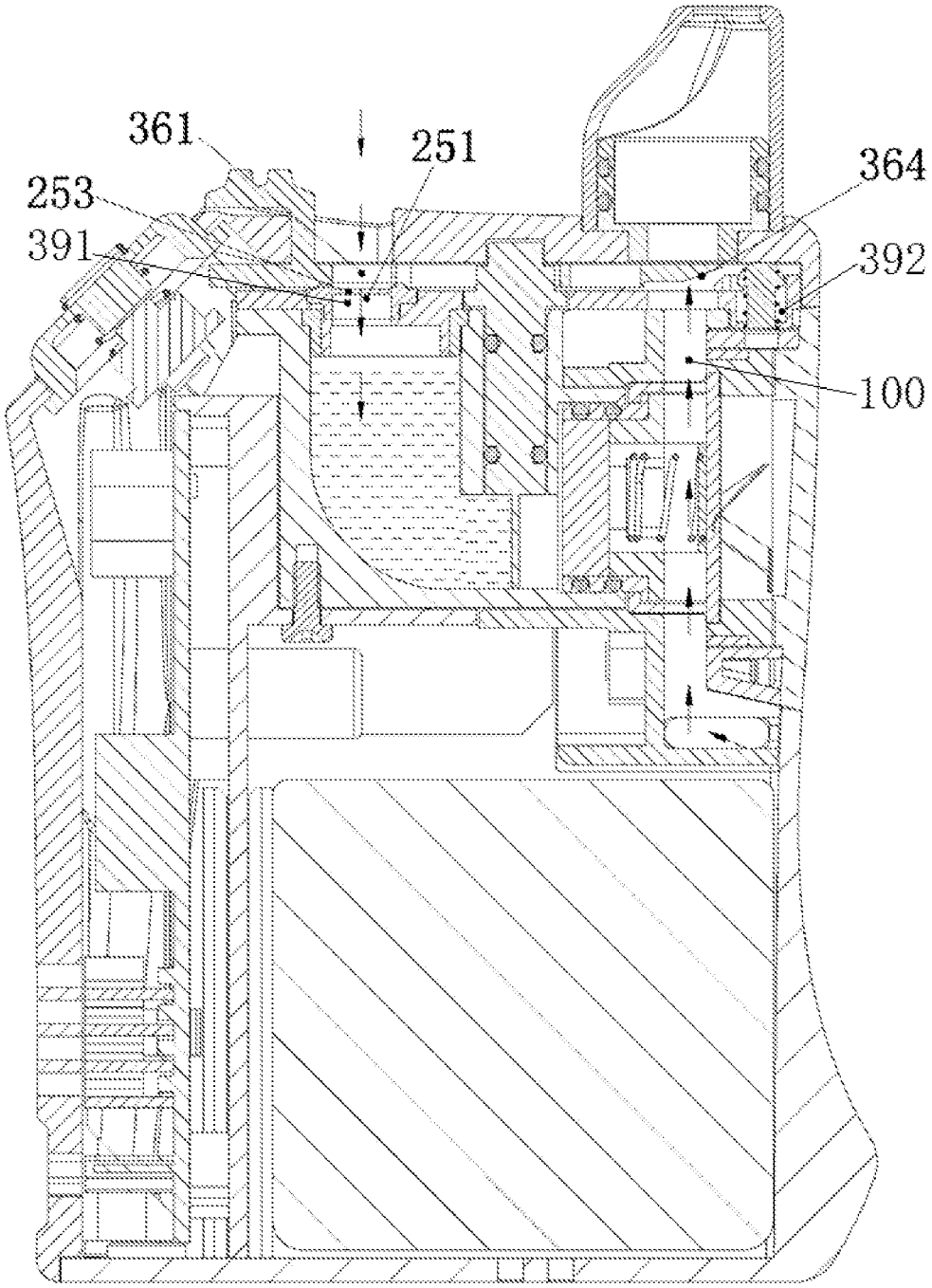
FIG. 2 is a schematic structural diagram of FIG. 1 when liquid is filled.
Figure 3:
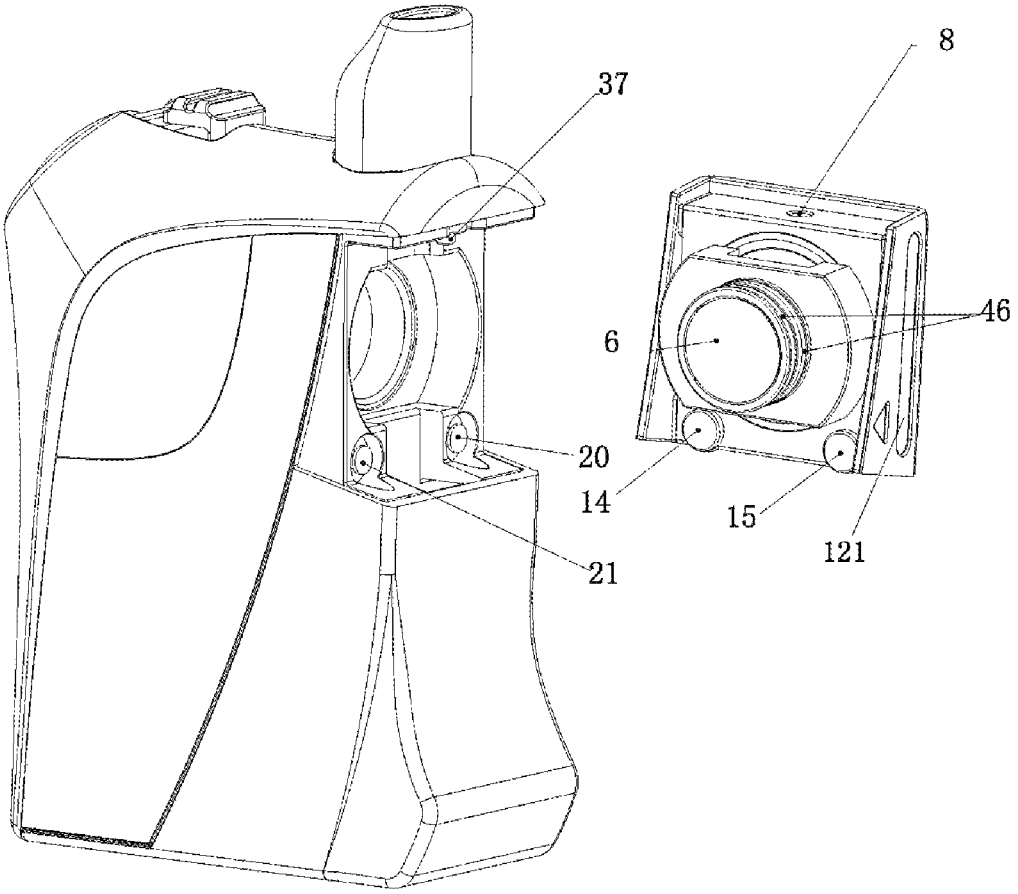
FIG. 3 is an exploded view of components of FIG. 1.
Figure 4:
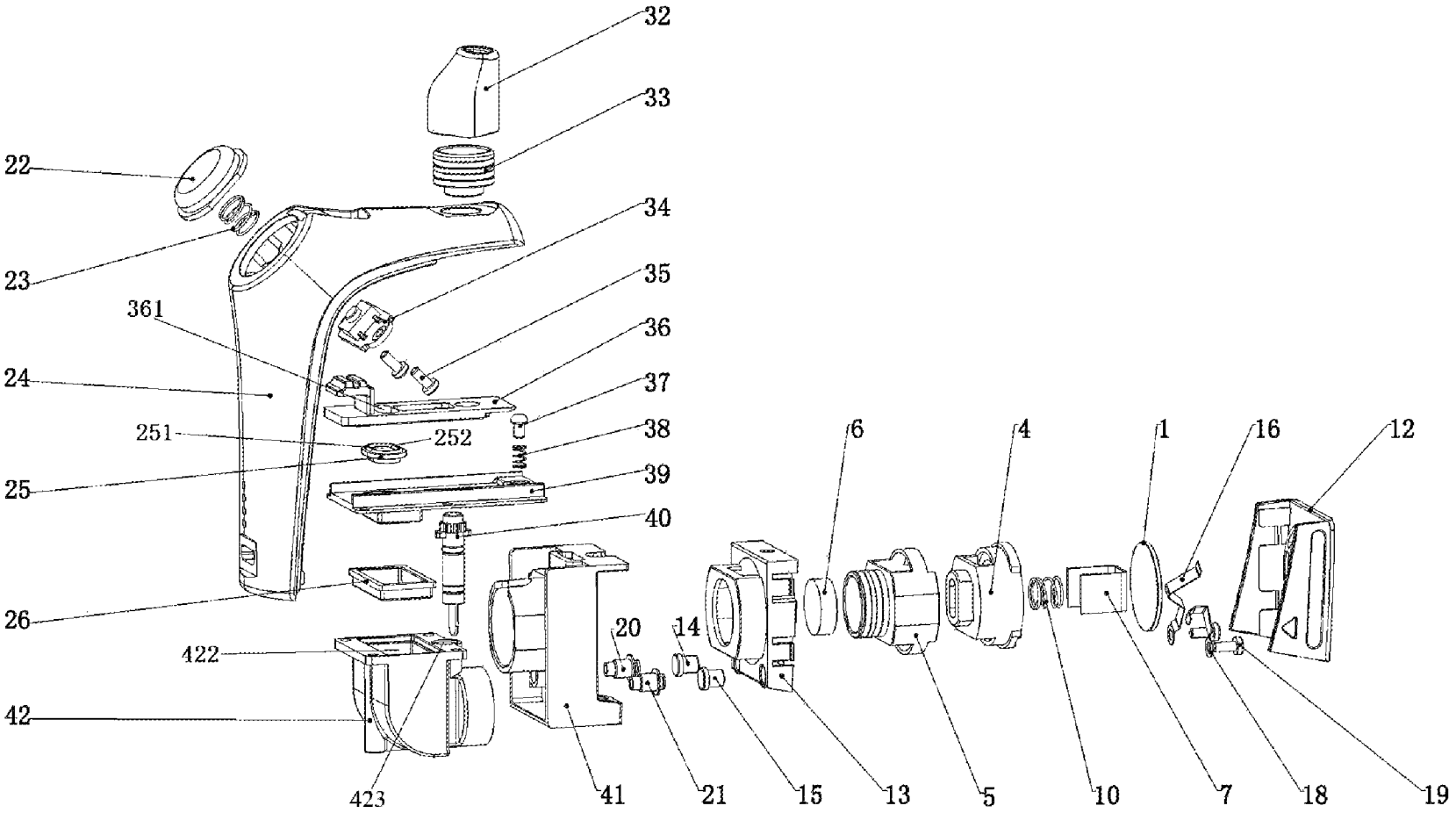
FIG. 4 is the upper half of the exploded view of FIG. 1.
Figure 5:
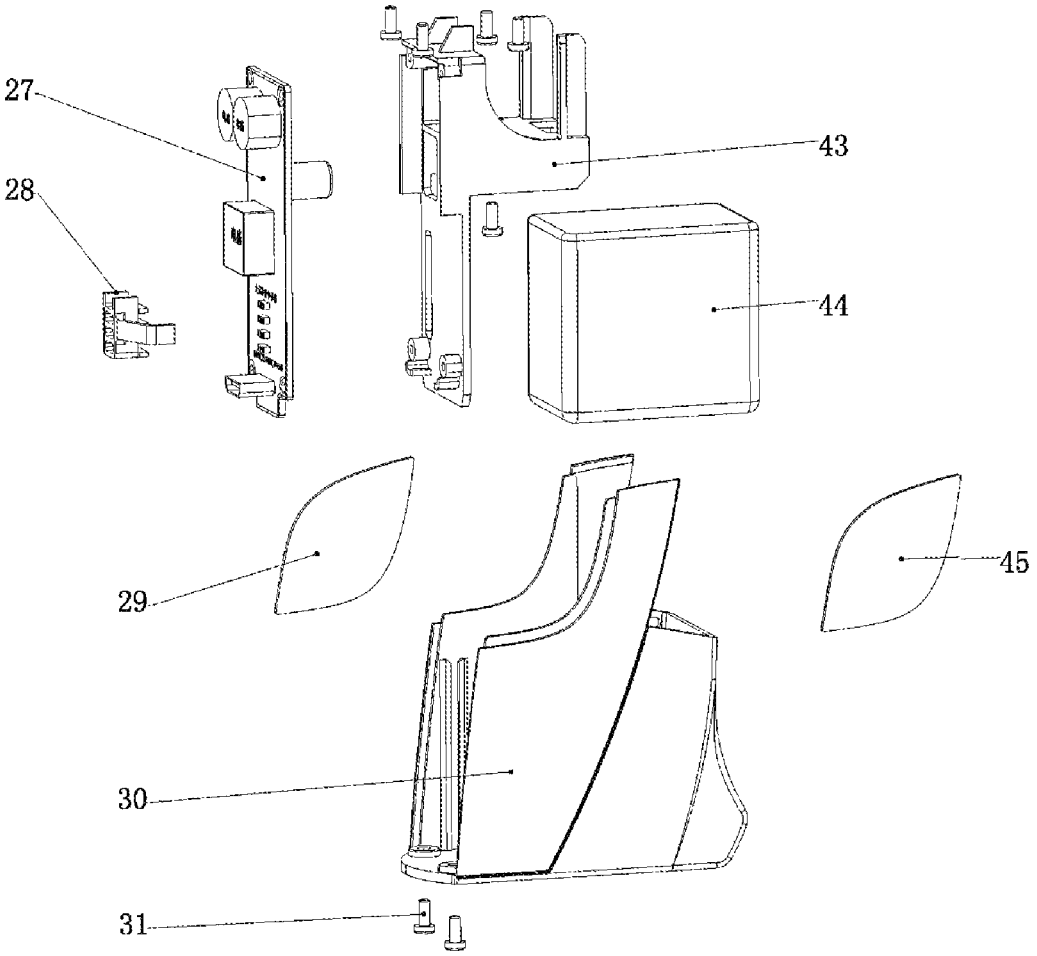
FIG. 5 is the lower half of the exploded view of FIG. 1.
Figure 6:
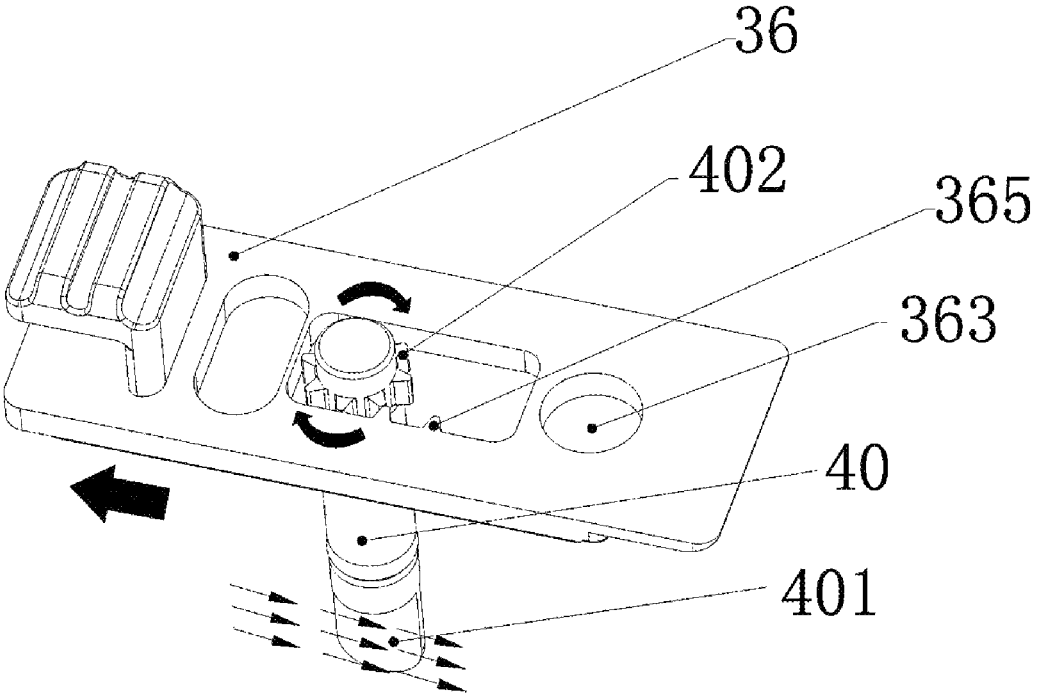
FIG. 6 is a schematic structural diagram of a liquid passing control structure in FIG. 1 when a liquid passing hole is opened.
Figure 7:
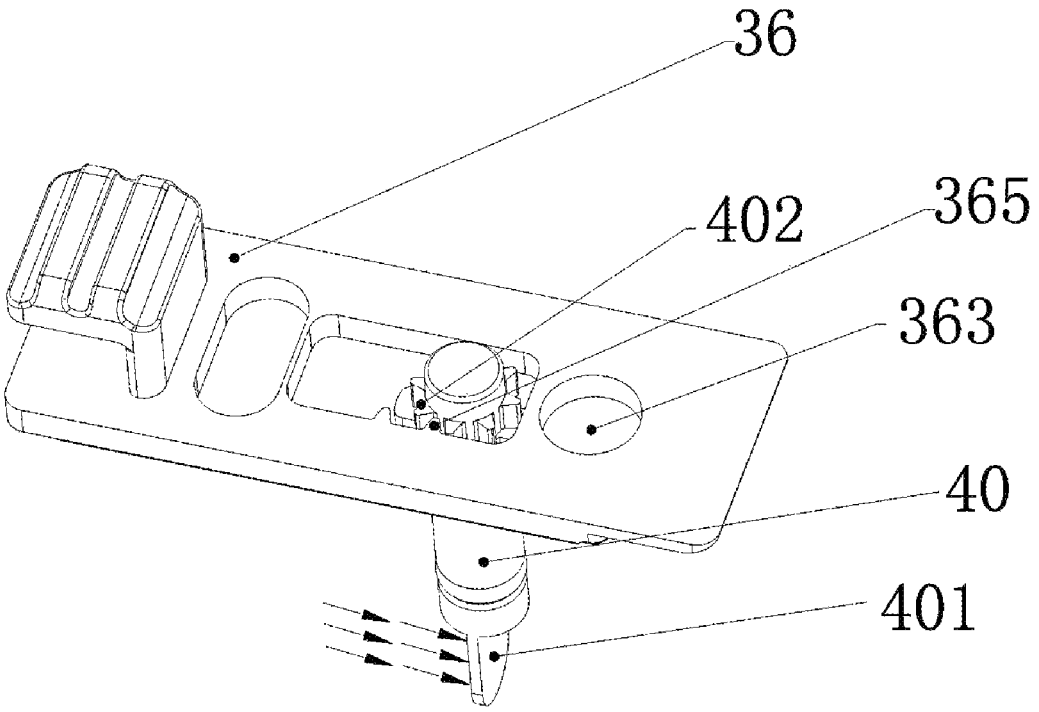
FIG. 7 is a schematic structural diagram of the liquid passing control structure in FIG. 1 when the liquid passing hole is closed.

In which, 1 ultrasonic atomization sheet, 2 cigarette liquid recycling hole, 3 cigarette liquid recycling groove, 4 atomization seat, 5 atomization sleeve, 6 liquid storage cotton, 7 U-shaped liquid guide cotton sheet, 8 locking hole, 9 air passing groove, 10 cotton pressing spring, 11 porous liquid guide body, 12 atomization core housing, 121 hand-held portion, 13 atomization cover, 14 positive electrode ring, 15 negative electrode ring, 16 positive elastic sheet, 17 positive screw, 18 negative elastic sheet, 19 negative screw, 20 positive elastic electrode, 21 negative elastic electrode, 22 key, 23 key spring, 24 upper shell, 25 silicone pad, 251 fourth liquid filling hole, 252 raised rib, 253 elastic sheet, 26 silicone ring, 27 main board, 28 LED (Light-emitting diode) holder, 29 first PC (Polycarbonate) sheet, 30 lower shell, 301 air inlet, 31 first fastening screw, 32 nozzle sleeve, 33 nozzle holder, 34 key board, 35 second fastening screw, 36 slider, 361 third liquid filling hole, 362 first bevel, 363 air passing hole, 364 bevel of the slider, 365 rack, 37 ball-head pin, 38 reset spring, 39 fixed plate, 391 second liquid filling hole, 40 rotating shaft, 401 liquid retaining plate, 402 gear, 41 upper support, 42 liquid bin, 421 liquid passing hole, 422 first liquid filling hole, 423 receiving groove, 424 guiding groove, 43 main support, 44 lithium cell, 45 second PC sheet, 46 seal ring, 47 atomization core inner sleeve, 48 atomization core outer sleeve, 49 cup-shaped liquid guide cotton, 50 sliding shaft, 501 second bevel, 502 limiting portion, 503 guiding salient point, 51 return spring.

DETAILED DESCRIPTION OF EMBODIMENTS

Embodiment 1 of Atomizer

As shown in FIGS. 1 to 7, the atomizer in Embodiment 1 of the present invention comprises an atomization core, an atomizer housing, and a liquid bin 42 in the atomizer housing. The atomizer housing comprises an upper shell 24 and a lower shell 30. The atomization core comprises an ultrasonic atomization sheet 1 and a liquid guide structure 60 connected to the ultrasonic atomization sheet 1. The operating frequency of the ultrasonic atomization sheet 1 is 1.7 to 2.4 MHz. The ultrasonic atomization sheet 1 is a solid piezoelectric ceramic sheet.

A liquid passing hole 421 for connecting the liquid guide structure 60 with the inner cavity 420 of the liquid bin 42 is formed in the side wall of the liquid bin 42, the liquid bin 42 is provided with a first liquid filling hole 422, the atomizer further comprises a liquid filling control structure for controlling the opening and closing of the first liquid filling hole 422 and a liquid passing control structure for controlling the opening and closing of the liquid passing hole 421, and the liquid filling control structure is linked with the liquid passing control structure; when the first liquid filling hole 422 is opened under the control of the liquid filling control structure, the liquid passing hole 421 is closed under the control of the liquid passing control structure; when the first liquid filling hole 422 is closed under the control of the liquid filling control structure, the liquid passing hole 421 is opened under the control of the liquid passing control structure.

Embodiment 1 further comprises an air outlet control structure for controlling the opening and closing of an air outlet channel 100 of the atomizer, and the air outlet control structure is linked with the liquid passing control structure; when the first liquid filling hole 422 is opened under the control of the liquid filling control structure, the air outlet channel 100 is closed under the control of the air outlet control structure; when the first liquid filling hole 422 is closed under the control of the liquid filling control structure, the air outlet channel 100 is opened under the control of the air outlet control structure.

The atomization core comprises an atomization core housing 12, the ultrasonic atomization sheet 1 and the liquid guide structure 60 are both fixed inside the atomization core housing 12, the atomization core extends into the atomizer housing from one side of the atomizer housing, and the atomization core housing 12 is exposed. Since the atomization core housing 12 is exposed, when replacing the atomization core, hands of an operator performing replacement are not stained with cigarette liquid, therefore clean and sanitary.

Embodiment 1 further comprises a locking structure capable of locking and fixing the atomization core; when the first liquid filling hole 422 is opened under the control of the liquid filling control structure, the atomization core is unlocked under the control of the locking structure; when the first liquid filling hole 422 is closed under the control of the liquid filling control structure, the atomization core is locked and fixed under the control of the locking structure. The atomization core is locked by the locking structure, so that the atomization core is unlikely to drop out. The atomization core can be replaced after unlocking the locking structure, so the operation is convenient. In the state of use, the atomization core can be locked to prevent the atomization core from dropping out due to various reasons (unintentional pull-out or vibration) during the use of the electronic cigarette to cause leakage of the cigarette liquid.

In Embodiment 1, the opening and closing of the liquid passing hole 421, the opening and closing of the air outlet channel 100, and the unlocking and locking of the atomization core are linked with the opening and closing of the first liquid filling hole 421, so the operation is simple, and the user experience is good; when liquid is filled, the liquid passing hole 421 is closed to prevent the cigarette liquid from being squeezed out from the liquid passing hole 421 due to the pressure increasing in the liquid bin 42 when liquid is filled into the liquid bin 42, thereby avoiding leakage or immersion of the liquid. When liquid is filled, the air outlet channel 100 is closed to prevent the user from sucking the electronic cigarette without closing the first liquid filling hole 422, thereby reducing the risk of liquid leakage.

The liquid filling control structure comprises a fixed plate 39 which disposed in the atomizer housing and fixed on the liquid bin 42, and a slider 36 capable of moves along the length of the fixed plate 39. The fixed plate 39 is provided with a second liquid filling hole 391 opposite to the first liquid filling hole 422, and the slider 36 is provided with a third liquid filling hole 361. When the slider 36 slides along the fixed plate 39, the third liquid filling hole 361 can be aligned or staggered with the first liquid filling hole 422. The way of liquid filling is a flat-push operation, so the operation is convenient.

The liquid passing control structure comprises a fixed plate 39 which disposed in the atomizer housing and fixed on the liquid bin 42, a slider 36 capable of moves along the length of the fixed plate 39, and a rotating shaft 40; a receiving groove 423 of which the axis is perpendicular to the axis of the liquid passing hole 421 is formed in the liquid bin 42, and the receiving groove 423 is communicated with the liquid passing hole 421; the rotating shaft 40 is located in the receiving groove 423, and a liquid retaining plate 401 is disposed at a position of the rotating shaft 40 corresponding to the liquid passing hole 421; the slider 36 is connected with the rotating shaft 40 in a transmission way, the slider 36 can drive the rotating shaft 40 to rotate until the liquid retaining plate 401 is perpendicular to the axis of the liquid passing hole 421 and closes the liquid passing hole 421, and the slider 36 can also drive the rotating shaft 40 to rotate until the liquid retaining plate 401 is parallel to the axis of the liquid passing hole 421 and opens the liquid passing hole 421. The slider 36 is provided with a rack 365 along the length of the said slider 36, and a gear 402 engaging with the rack 365 is disposed on the rotating shaft 40. With the principle of gear-rack transmission, when the first liquid filling hole 422 is opened (the slider 36 moves to the left), the slider 36 drives the rotating shaft 40 to rotate 90°, so that the liquid retaining plate 401 is perpendicular to the axis of the liquid passing hole 421, and the liquid retaining plate 401 closes the liquid passing hole 421; when the first liquid filling hole 422 is closed (the slider 36 moves to the right), the slider 36 drives the rotating shaft 40 to rotate 90° in the opposite direction, so that the liquid retaining plate 401 is parallel to the axis of the liquid passing hole 421, the liquid retaining plate 401 does not block the liquid passing hole 421, and the liquid passing hole 421 is opened.

The air outlet control structure comprises a fixed plate 39 which disposed in the atomizer housing and fixed on the liquid bin 42, and a slider 36 capable of moves along the length of the fixed plate 39. The slider 36 is provided with an air passing hole 363. When the slider 36 slides along the fixed plate 39, the slider 36 drives the air passing hole 363 to open or close the air outlet channel 100. The slider 36 is provided with an air passing hole 363, which can be aligned or staggered with the air outlet channel 100 by reciprocating motion of the slider 36, so that the air outlet channel 100 is closed or opened. In the state of use, the air passing hole 363 opens the air outlet channel 100, the entire air channel is opened, and the user can smoke normally; when liquid is filled, the air passing hole 363 closes the air outlet channel 100, the entire air channel is closed, and the user can not smoke.

The locking structure comprises a fixed plate 39 which disposed in the atomizer housing and fixed on the liquid bin 42, a slider 36 capable of moves along the length of the fixed plate 39, and a ball-head pin 37 capable of moves up and down along a through hole 392 of the fixed plate 39, where the external of the ball-head pin 37 is sleeved with a reset spring 38, and the bottom of the reset spring 38 is supported on the inner side wall of the through hole; the bottom of the slider 36 is provided with a bevel of the slider 364 corresponding to the head of the ball-head pin 37, and the atomization core is provided with a locking hole 8 corresponding to the ball-head pin 37. The atomization core housing 12 is provided with a hand-held portion 121.

When the slider 36 is pushed to open the first liquid filling hole 422, the slider 36 is linked with the rotating shaft 40 to rotate so that the liquid retaining plate 401 seals the liquid passing hole 421, the slider 36 is also linked with the atomization core for unlocking, and the atomization core can be pulled out for replacement to prevent liquid leakage.

The contact portion of the bottom surface between the slider 36 and the ball-head pin 37 is of a bevel structure. When the slider 36 reciprocates, the ball-head pin 37 can be driven to move up and down to unlock and lock the atomization core. In the state of use, the slider 36 abuts against the head of the ball-head pin 37, and the ball-head pin 37 is inserted into the locking hole 8 of the atomization core to lock the atomization core; when the first liquid filling hole 422 is opened, the slider 36 leaves the top of the ball-head pin 37, and the ball-head pin 37 moves upward under the effect of the reset spring 38 and exits the locking hole 8 of the atomization core to unlock the atomization core. With the hand-held portion 121, the atomization core is more convenient to replace.

A silicone pad 25 is disposed in the second liquid filling hole 391, the silicone pad 25 is provided with raised ribs 252 on the side facing the slider 36, and the center of the silicone pad 25 is provided with a fourth liquid filling hole 251 opposite to the second liquid filling hole 391. When liquid is not filled, the slider 36 presses the raised ribs 252 of the silicone pad 25 to seal the cigarette liquid, and avoid excessive resistance caused by large-area squeeze sealing method when the slider 36 is opened.

An elastic sheet 253 is disposed in the fourth liquid filling hole 251, and the elastic sheet 253 is unilaterally connected to the silicone pad 25. The elastic sheet 253 is unilaterally connected to the silicone pad 25, a liquid filling nozzle is pressed down to open the elastic sheet 253 for filling liquid, and the elastic sheet 253 is restored to the initial position after the liquid is filled, so that the cigarette liquid can be prevented from being thrown out by shaking the cigarette when the first liquid filling hole 422 is not closed.

A silicone ring 26 is disposed between the liquid bin 42 and the fixed plate 39. The silicone ring 26 is used to seal the cigarette liquid.

Figure 8:
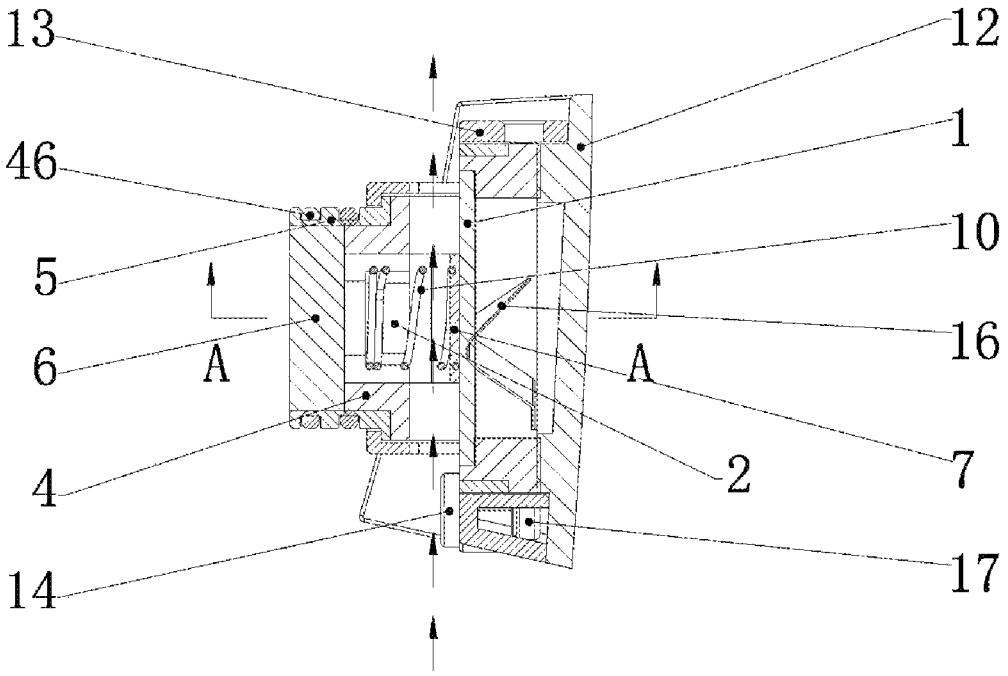
FIG. 8 is a front cross-sectional view of an atomization core in FIG. 1.
Figure 9:
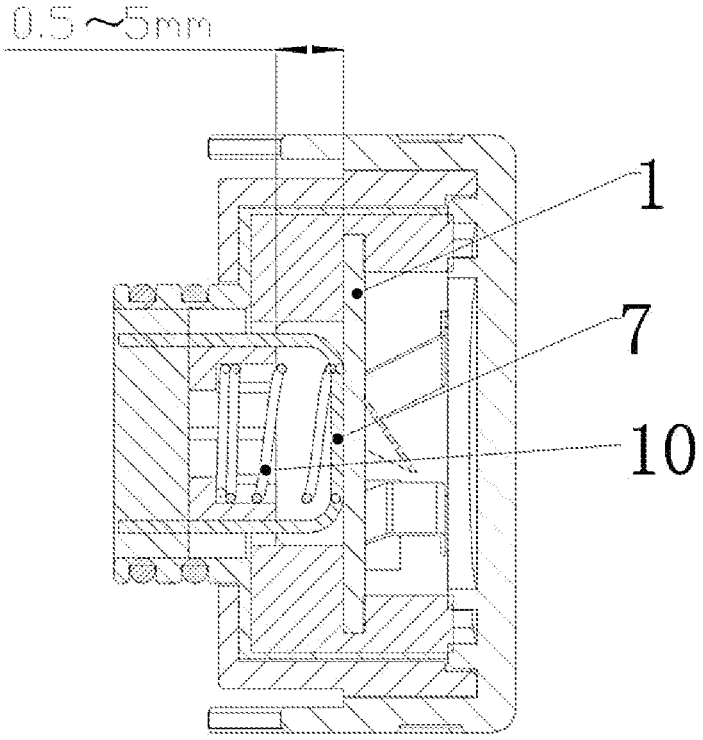
FIG. 9 is an A-A view of FIG. 8.
Figure 10:
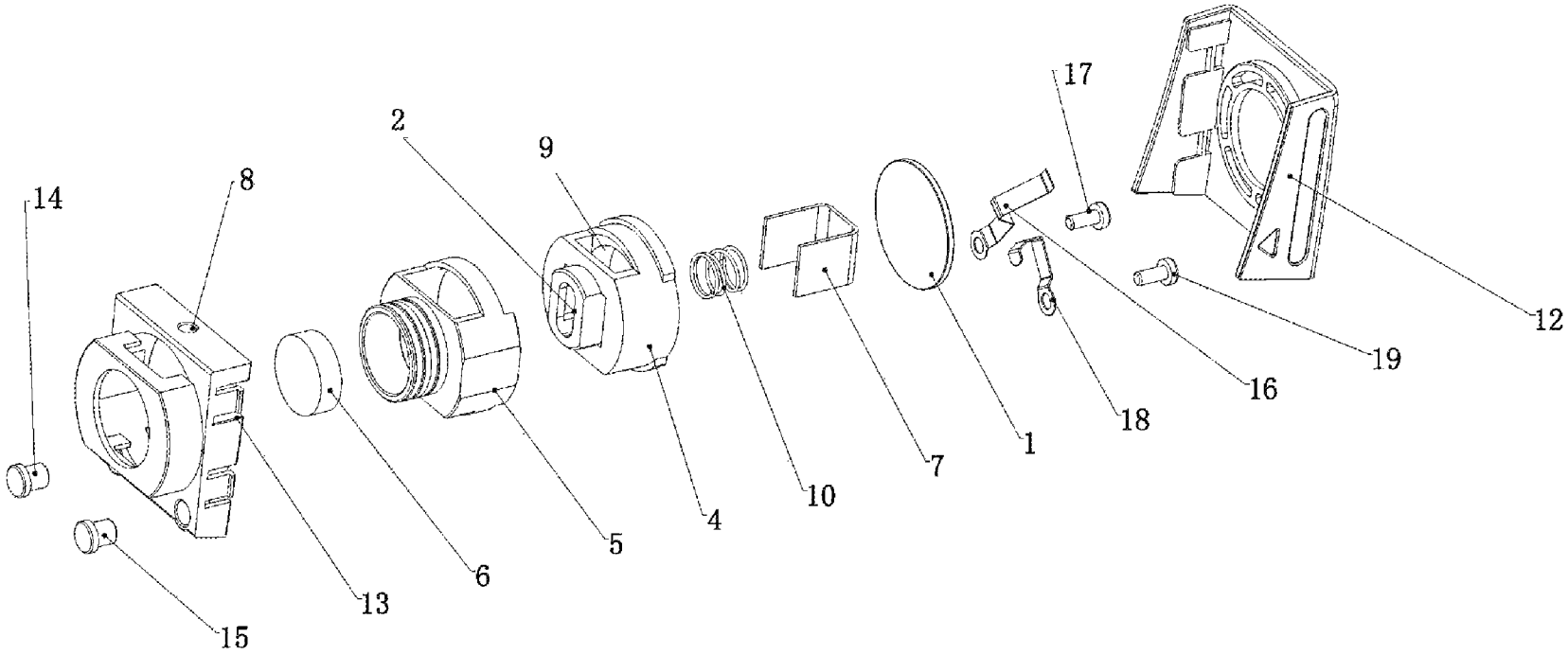
FIG. 10 is an exploded view of FIG. 8.
Figure 11:
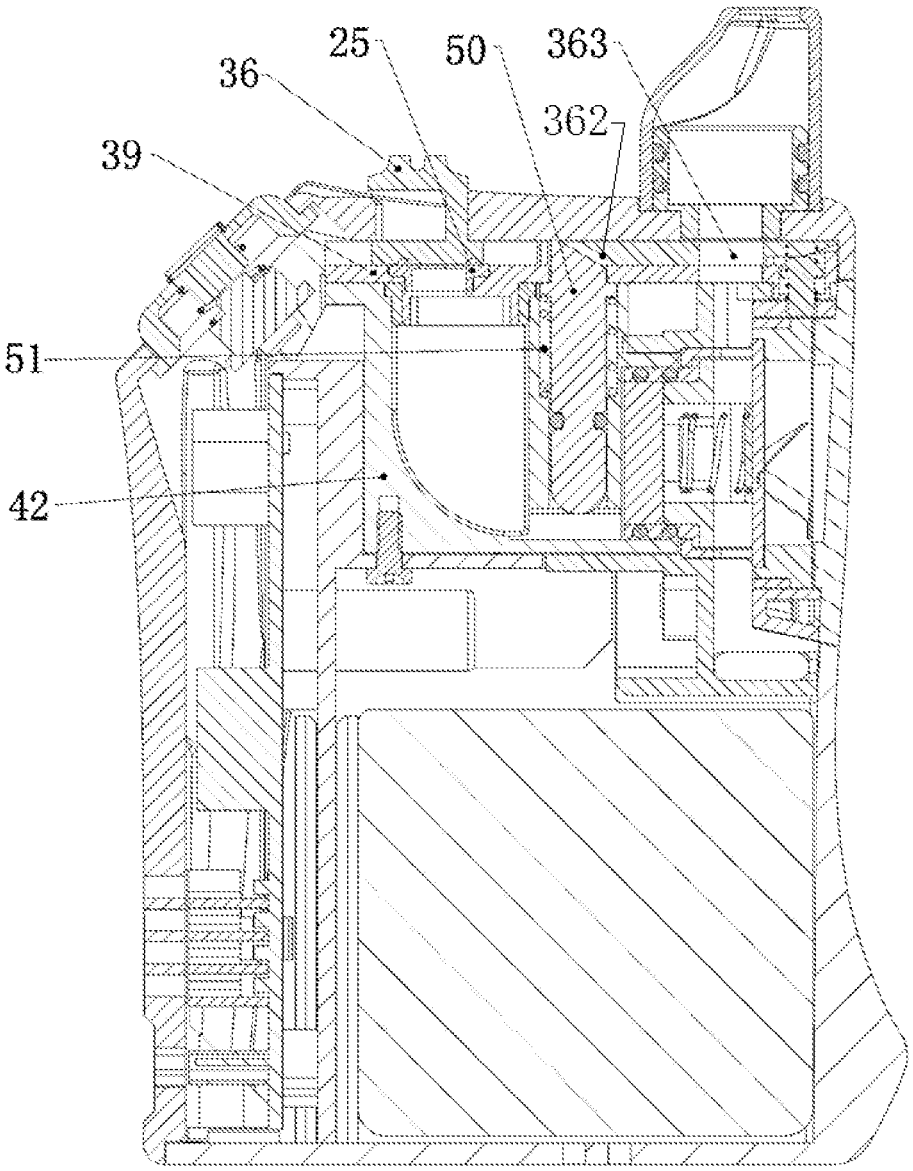
FIG. 11 is a front cross-sectional view of Embodiment 2 of an atomizer.
Figure 12:
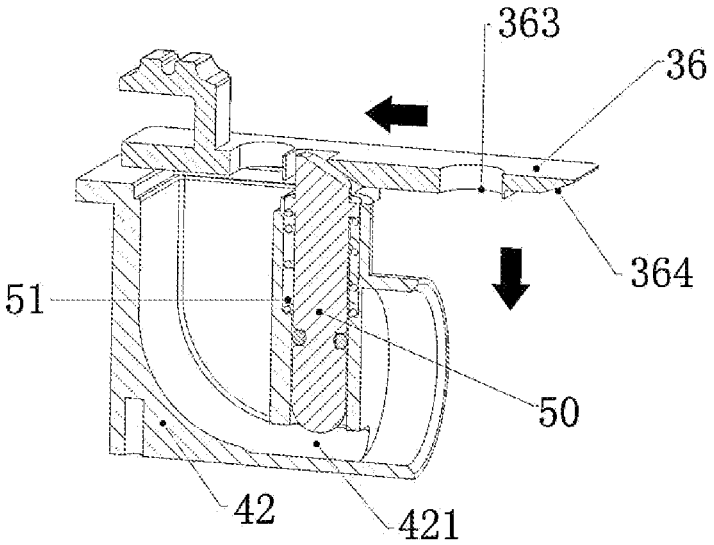
FIG. 12 is a schematic structural diagram of a liquid passing control structure in FIG. 11 when a liquid passing hole is opened.
Figure 13:
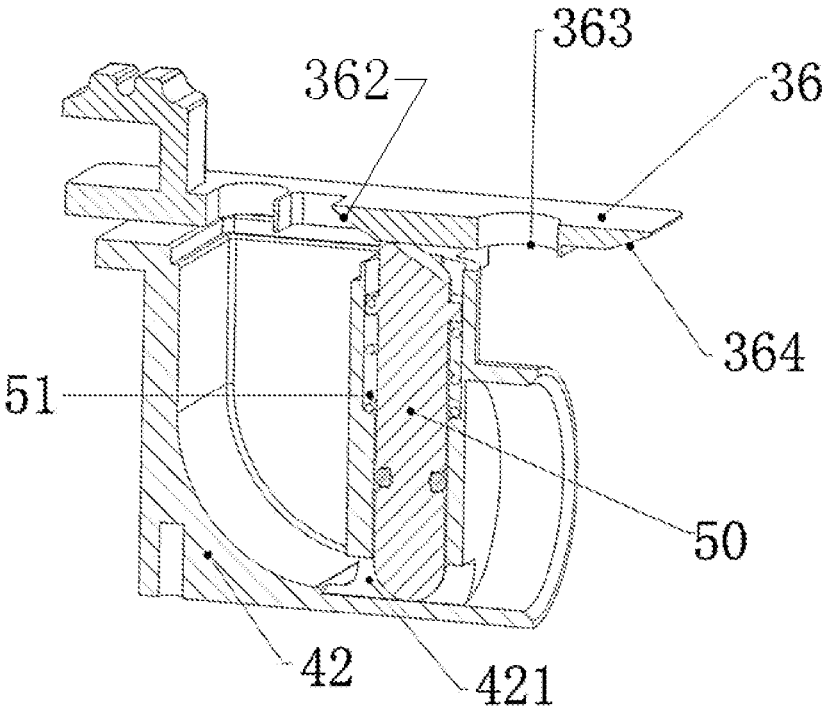
FIG. 13 is a schematic structural diagram of the liquid passing control structure in FIG. 11 when the liquid passing hole is closed.
Figure 14:
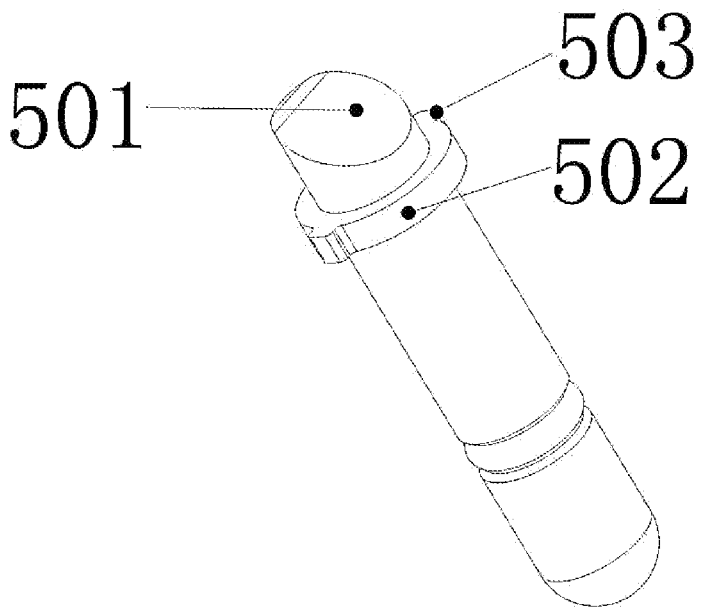
FIG. 14 is a schematic structural diagram of a sliding shaft in FIG. 11.
Figure 15:
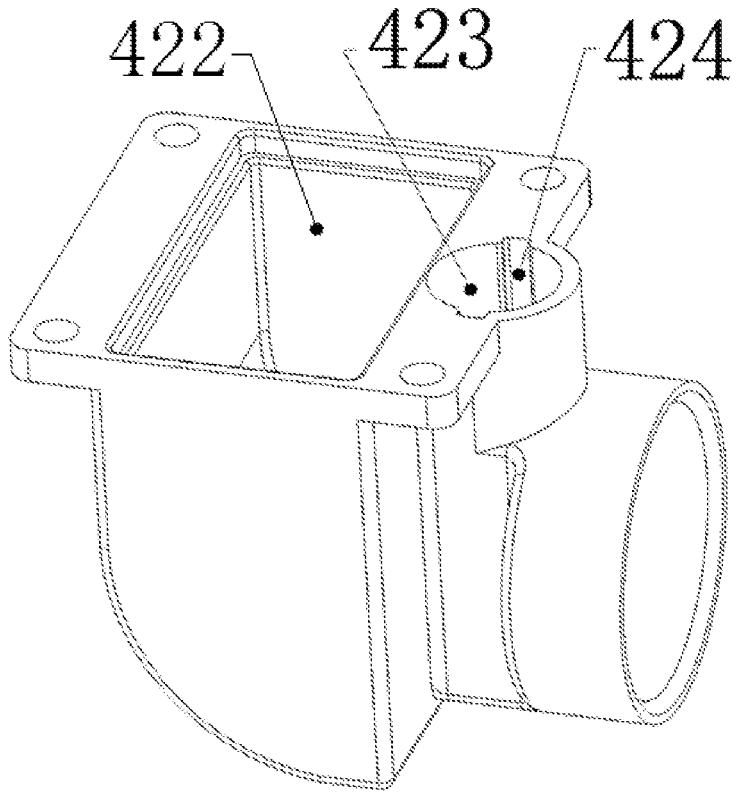
FIG. 15 is a schematic structural diagram of a liquid bin in FIG. 11.

As shown in FIG. 8 to FIG. 10, the atomization core comprises an atomization seat 4, an atomization sleeve 5, and an atomization cover 13, where the atomization sleeve 5 is fixed between the atomization cover 13 and the atomization core housing 12; the ultrasonic atomization sheet 1 is fixed in the atomization seat 4 and the ultrasonic atomization sheet 1 is parallel to the length direction of the electronic cigarette, the atomization seat 4 is sleeved in the atomization sleeve 5, the liquid guide structure 60 comprises liquid storage cotton 6 and a U-shaped liquid guide cotton sheet 7, the liquid storage cotton 6 is fixed in the atomization sleeve 5, two opposite sides of the U-shaped liquid guide cotton sheet 7 pass through the atomization sleeve 5 and are connected with the liquid storage cotton 6, and the outside of a third side of the U-shaped liquid guide cotton sheet 7 abuts against the ultrasonic atomization sheet 1; the liquid storage cotton 6 is communicated with the liquid bin 42 through the liquid passing hole 421; the atomization sleeve 5 is provided with an air passing groove 9 for connecting the inside of the third side of the U-shaped liquid guide cotton sheet 7 with an air inlet 301 and a nozzle sleeve 32 on the atomizer. The width of the air passing groove 9 is 0.5 to 5 mm.

The external of the atomization sleeve 5 is sleeved with a seal ring 46 for sealing cigarette liquid.

The atomization core further comprises a cotton pressing spring 10, one end of the cotton pressing spring 10 abuts against the inside of the third side of the U-shaped liquid guide cotton sheet 7, and the other end of the cotton pressing spring 10 abuts against the inner wall of the atomization seat 4. The cotton pressing spring 10 can prevent deformation of the U-shaped liquid guide cotton sheet 7, meanwhile, since the top end of the cotton pressing spring 10 does not directly abut against the liquid storage cotton 6, the liquid storage cotton 6 can be prevented from being separated from the atomization sleeve as well.

The inside of the third side of the U-shaped liquid guide cotton sheet 7 is communicated with the liquid storage cotton 6 through a cigarette liquid recycling hole 2 on the atomization seat 4. The atomization region of the ultrasonic atomization sheet 1 is communicated with the liquid storage cotton 6 through the cigarette liquid recycling hole 2, so that the large granular cigarette liquid generated during atomization performed by the ultrasonic atomization sheet 1 can be directly sprayed onto the liquid storage cotton 6 through the cigarette liquid recycling hole 2, and then guided to the ultrasonic atomization sheet 1 through the U-shaped liquid guide cotton sheet 7 again for secondary recycling.

A positive electrode ring 14 and a negative electrode ring 15 are embedded into the atomization cover 13; one side of the ultrasonic atomization sheet 1 is attached to one end of a positive elastic sheet 16, and the other end of the positive elastic sheet 16 is locked with the positive electrode ring 14 by a positive screw 17; the other side of the ultrasonic atomization sheet 1 is attached to one end of a negative elastic sheet 18, and the other end of the negative elastic sheet 18 is locked with the negative electrode ring 15 by a negative screw 19; a positive elastic electrode 20 attached to the positive electrode ring 14 and a negative elastic electrode 21 attached to the negative electrode ring 15 are arranged in the atomizer housing. Positive and negative silver layers of the ultrasonic atomization sheet 1 are selectively attached to each other by means of the positive elastic sheet 16 and the negative elastic sheet 18 to conduct electricity, the positive and negative elastic sheets are respectively locked to the positive and negative electrode rings by means of the positive and negative screws for fixing and electric conduction. The entire ultrasonic atomization sheet 1 does not need solder wires for electric conduction, convenient to assemble, and can also avoid depolarization of the ultrasonic atomization sheet 1 due to over-heated solder wires; meanwhile, the ultrasonic atomization sheet 1 is not plated with tin, which can avoid pollution to the cigarette liquid and is more environment-friendly and sanitary. After the atomization core is assembled into the atomizer, the electric circuit is conducted directly by contact between the elastic electrodes and the electrode rings, so the disassembly and assembly are convenient, and the operation is reliable. After the atomization core is inserted into the atomizer and locked by the ball-head pin 37, the liquid storage cotton 6 is communicated with the inner cavity 420 of the liquid bin 42 through the liquid passing hole 421 on the liquid bin 42, the liquid channel is connected; the outer end face of the positive electrode ring 14 abuts against the positive elastic electrode 20, and the outer end face of the negative electrode ring 15 abuts against the negative elastic electrode 21, the circuit is connected. Hence, it is very convenient to replace the atomization core by only a pull-out operation, and the hands are stained with no liquid. The atomization core provided with a locking mechanism, therefore it is unlikely to drop out.

The atomizer further mainly comprises a key 22, a key spring 23, a main board 27, an LED holder 28, a first PC sheet 29, a first fastening screw 31, a nozzle holder 33, a key board 34, a second fastening screw 35, an upper support 41, a main support 43, a lithium cell 44, a second PC sheet 45, and a plurality of seal rings 46 for sealing the cigarette liquid, the structure and positional relationship of each component are shown in the drawings.

Embodiment 2 of Atomizer

The structure of the atomizer in Embodiment 2 is shown in FIG. 11 to FIG. 15. The structure of the atomizer in Embodiment 2 is similar to that in Embodiment 1, the difference between Embodiment 2 and Embodiment 1 is the liquid passing control structure. The liquid passing control structure in Embodiment 2 comprises a fixed plate 39 which disposed in the atomizer housing and fixed on the liquid bin 42, a slider 36 capable of moves along the length of the fixed plate 39, and a sliding shaft 50; a receiving groove 423 whose axis is perpendicular to the axis of the liquid passing hole 421 is formed in the liquid bin 42, and the receiving groove 423 is communicated with the liquid passing hole 421; the sliding shaft 50 is located in the receiving groove 423; the slider 36 is connected with the sliding shaft 50 in a transmission way, and the slider 36 can drive the sliding shaft 50 to slide up and down along the receiving groove 423 and to open or close the liquid passing hole 421.

The bottom of the slider 36 is provided with a first bevel 362, the top of the sliding shaft 50 is provided with a second bevel 501 corresponding to the first bevel 362, the external of the sliding shaft 50 is sleeved with a return spring 51, the sliding shaft 50 is provided with a limiting portion 502, the bottom end of the return spring 51 is supported on a step of the inner side wall of the receiving groove 423, and the top end of the return spring 51 abuts against the limiting portion 502.

A vertical guiding groove 424 is formed in the inner side wall of the receiving groove 423, and the sliding shaft 50 is provided with a guiding salient point 503 matching the vertical guiding groove 424.

Embodiment 3 of Atomizer

Figure 16:
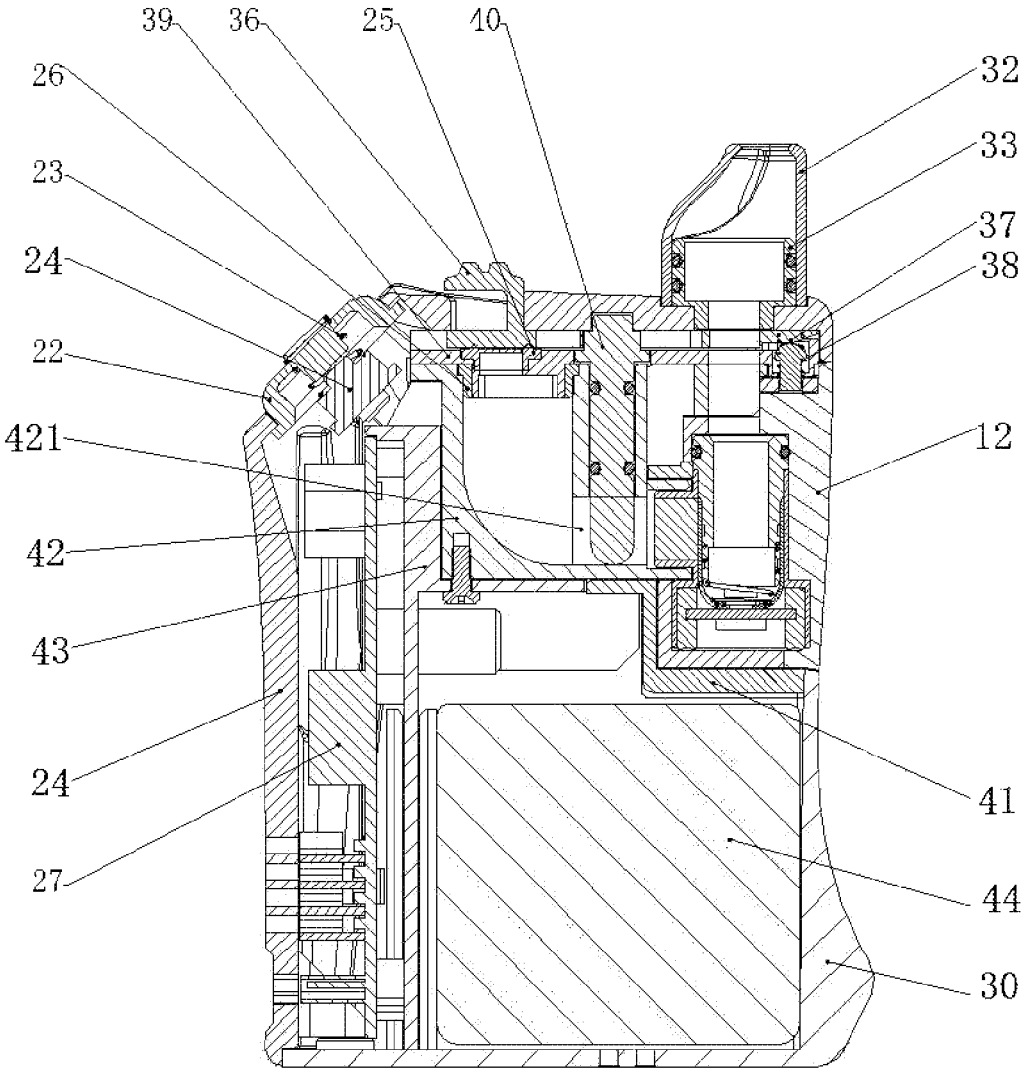
FIG. 16 is a front cross-sectional view of Embodiment 3 of an atomizer according to the present invention.

The structure of the atomizer in Embodiment 3 is shown in FIG. 16. The structure of the atomizer in Embodiment 3 is similar to that in Embodiment 1, the difference between Embodiment 3 and Embodiment 1 is the structure of the atomization core.

Figure 17:
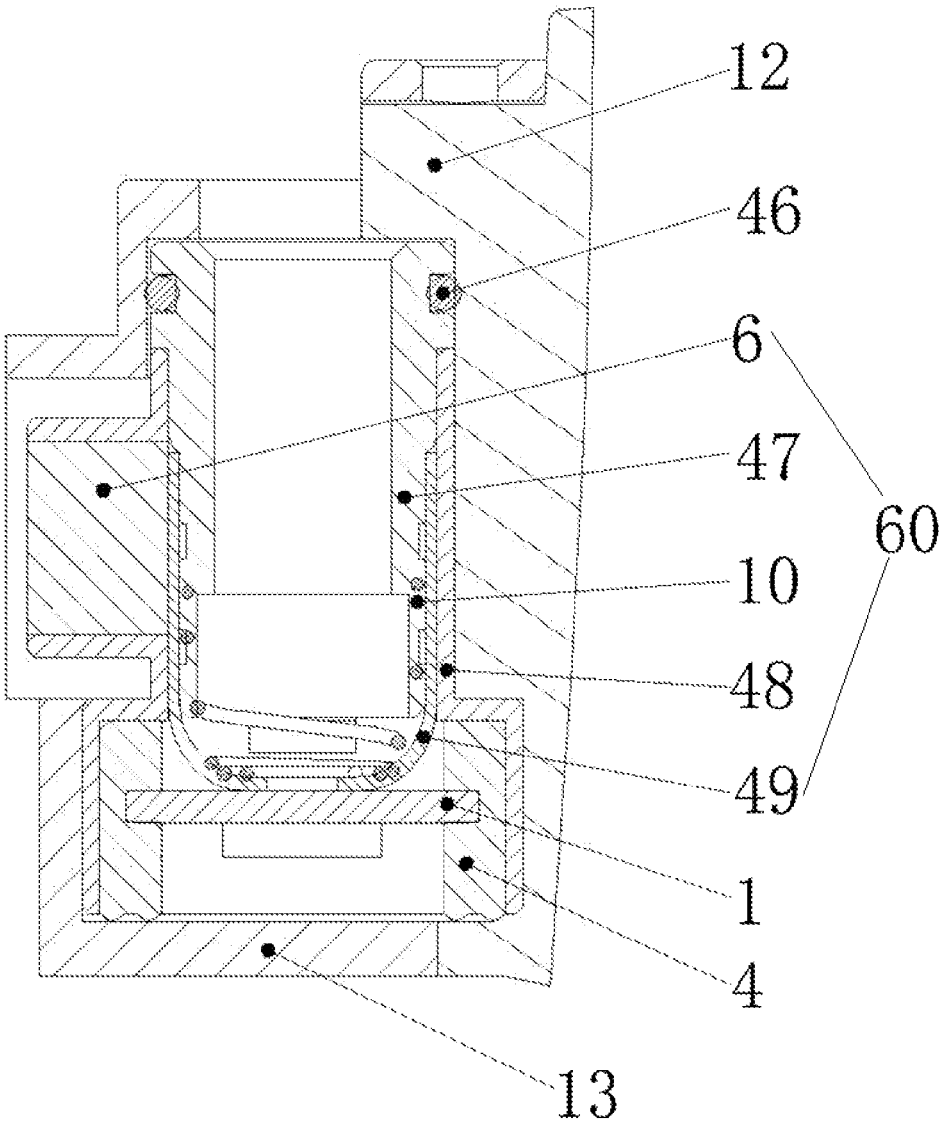
FIG. 17 is a schematic structural diagram of an atomization core in FIG. 16.

As shown in FIG. 17, in Embodiment 3, the atomization core comprises an atomization seat 4, an atomization core inner sleeve 47, an atomization core outer sleeve 48, and an atomization cover 13, where the ultrasonic atomization sheet 1 is fixed in the atomization seat 4 and is perpendicular to the length direction of the electronic cigarette, the atomization seat 4 is fixed in the bottom end of the atomization core outer sleeve 48, the liquid guide structure 60 comprises liquid storage cotton 6 and cup-shaped liquid guide cotton 49, the liquid storage cotton 6 is fixed in the atomization core outer sleeve 48, the side wall of the cup-shaped liquid guide cotton 49 is sandwiched between the atomization core outer sleeve 48 and the atomization core inner sleeve 47, the side wall of the cup-shaped liquid guide cotton 49 is connected to the liquid storage cotton 6, and the bottom of the cup-shaped liquid guide cotton 49 abuts against the ultrasonic atomization sheet 1; the liquid storage cotton 6 is communicated with the liquid bin 42; the atomization core inner sleeve 47 and the atomization core outer sleeve 48 are fixed between the atomization cover 13 and the atomization core housing 12; the atomization cover 13 is provided with an air passing groove 9 for connecting the inside of the cup-shaped liquid guide cotton 49 with an air inlet 301 and a nozzle sleeve 32 on the atomizer. The atomization core inner sleeve 47 is sleeved with a seal ring 46 for sealing cigarette liquid.

The atomization core further comprises a cotton pressing spring 10, one end of the cotton pressing spring 10 abuts against the inner bottom surface of the cup-shaped liquid guide cotton 49, and the other end of the cotton pressing spring 10 abuts against the inner side wall of the atomization core inner sleeve 47.

Figure 18:
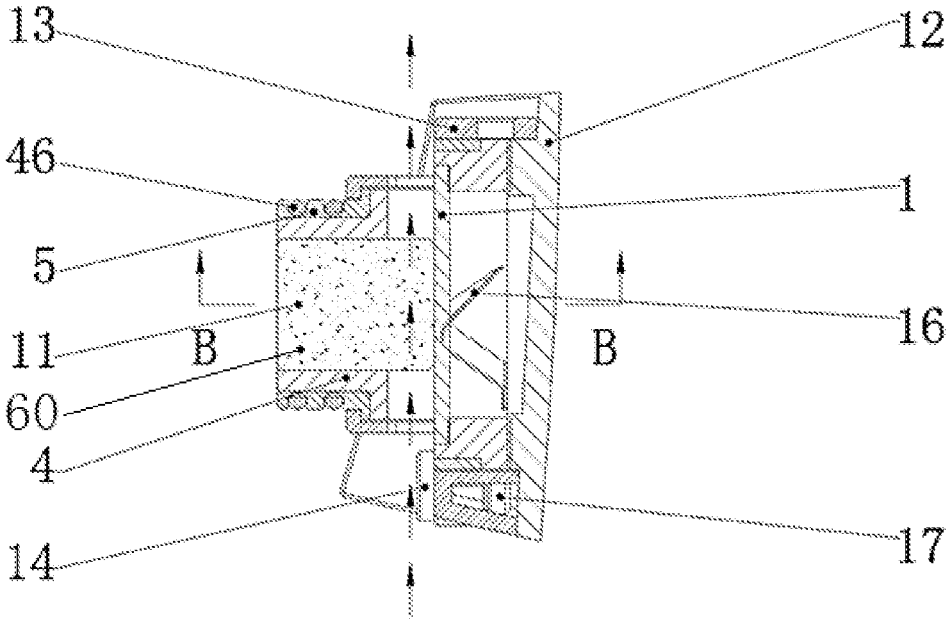
FIG. 18 is a front cross-sectional view of Embodiment 2 of an atomization core.
Figure 19:
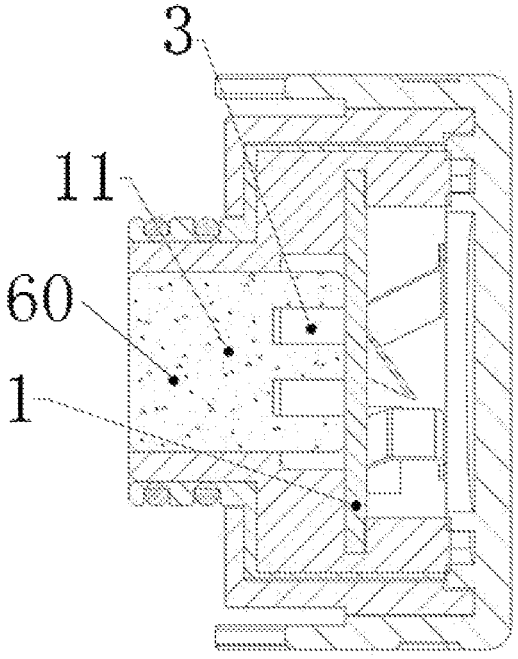
FIG. 19 is a B-B view of FIG. 18.
Figure 20:
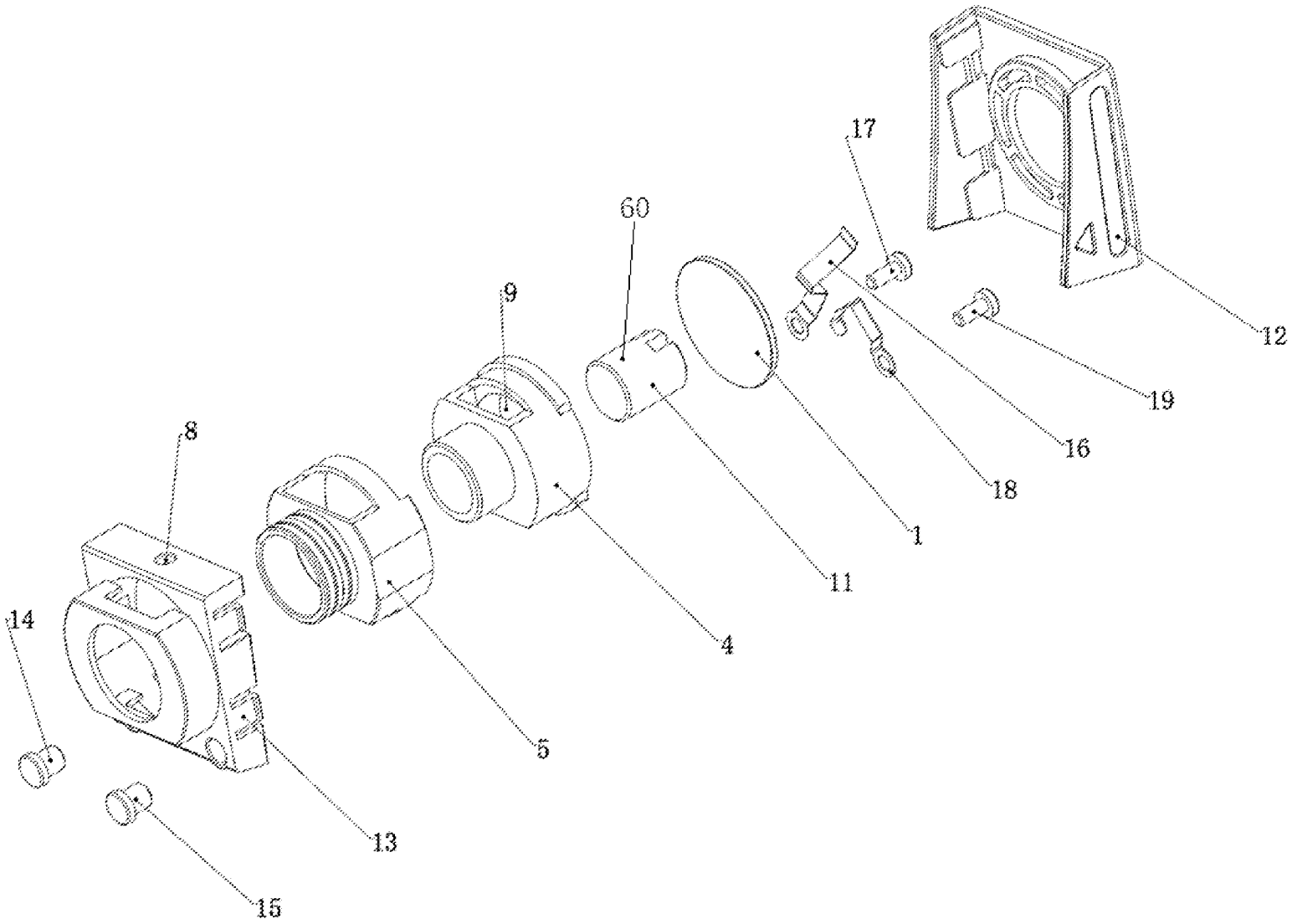
FIG. 20 is an exploded view of FIG. 18.

The atomization core in Embodiment 1, Embodiment 2 and Embodiment 3 of the atomizer can also be replaced with the atomization core in FIG. 18 to FIG. 20. As shown in FIG. 18 to FIG. 20, the atomization core comprises an ultrasonic atomization sheet 1 and a liquid guide structure 60 for guiding cigarette liquid to the surface of the ultrasonic atomization sheet 1, and a cigarette liquid recycling groove 3 is disposed between an atomization region of the ultrasonic atomization sheet 1 and the liquid guide structure 60.

The atomization core further comprises an atomization seat 4 and an atomization sleeve 5, the ultrasonic atomization sheet 1 is fixed in the atomization seat 4, the atomization seat 4 is sleeved in the atomization sleeve 5, the liquid guide structure 60 comprises a porous liquid guide body 11, the porous liquid guide body 11 is embedded in the atomization seat 4, the outer end face of the porous liquid guide body 11 is communicated with the liquid bin 42 of the electronic cigarette, and the inner end face of the porous liquid guide body 11 abuts against the ultrasonic atomization sheet 1; the cigarette liquid recycling groove 3 is formed in the inner end face of the porous liquid guide body 11. The external of the atomization sleeve 5 is sleeved with a seal ring 46 for sealing cigarette liquid.

The atomization sleeve 5 is provided with an air passing groove 9 for connecting the cigarette liquid recycling groove 3 with the outside.

The atomization core further comprises an atomization core housing 12 and an atomization cover 13, and the atomization sleeve 5 is fixed between the atomization cover 13 and the atomization core housing 12; a positive electrode ring 14 and a negative electrode ring 15 are embedded into the atomization cover 13, the positive electrode ring 14 is electrically connected to a positive pole of a power supply, and the negative electrode ring 15 is electrically connected to a negative pole of the power supply; one side of the ultrasonic atomization sheet 1 is attached to one end of a positive elastic sheet 16, the other end of the positive elastic sheet 16 is locked with the positive electrode ring 14 by a positive screw 17, the other side of the ultrasonic atomization sheet 1 is attached to one end of a negative elastic sheet 18, and the other end of the negative elastic sheet 18 is locked with the negative electrode ring 15 by a negative screw 19.

The embodiments of the present invention are described above with reference to the drawings, but the present invention is not limited to the specific embodiments. The specific embodiments described above are merely illustrative but not restrictive. Many forms may also be made by those of ordinary skill in the art under the enlightenment of the present invention without departing from the purpose of the present invention and the scope of the claims, and these forms fall into the scope of the present invention.

The invention claimed is:

1. An ultrasonic electronic cigarette atomizer, comprising an atomization core, an atomizer housing, and a liquid bin (42) in the atomizer housing, the atomization core comprising an ultrasonic atomization sheet (1) and a liquid guide structure (60) connected to the ultrasonic atomization sheet (1), wherein the liquid guide structure (60) and an inner cavity of the liquid bin (42) are communicated through a liquid passing hole (421) which is disposed on a side wall of the liquid bin (42), and the liquid bin (42) is provided with a first liquid filling hole (422), wherein the atomizer further comprises a liquid filling control structure for controlling the opening and closing of the first liquid filling hole (422) and a liquid passing control structure for controlling the opening and closing of the liquid passing hole (421), and the liquid filling control structure is linked with the liquid passing control structure; wherein, when the first liquid filling hole (422) is opened under the control of the liquid filling control structure, the liquid passing hole (421) is closed under the control of the liquid passing control structure; and wherein, when the first liquid filling hole (422) is closed under the control of the liquid filling control structure, the liquid passing hole (421) is opened under the control of the liquid passing control structure;

wherein the liquid filling control structure comprises a fixed plate (39) which is disposed in the atomizer housing and fixed on the liquid bin (42), and a slider (36) capable of moves along the length of the fixed plate (39); the fixed plate (39) is provided with a second liquid filling hole (391) opposite to the first liquid filling hole (422), and the slider (36) is provided with a third liquid filling hole (361); when the slider (36) slides along the fixed plate (39), the third liquid filling hole (361) can be aligned or staggered with the first liquid filling hole (422);

the liquid passing control structure comprises the fixed plate (39), the slider (36), and a shaft (40, 50) which is connected with the slider (36) in a transmission way;

a receiving groove (423) whose axis is perpendicular to the axis of the liquid passing hole (421) is formed in the liquid bin (42), and the receiving groove (423) is communicated with the liquid passing hole (421); the shaft (40,50) is located in the receiving groove (423); and the movement of the slider (36) drives the shaft (40,50) to move, so as to open or close the liquid passing hole (421).

2. The ultrasonic electronic cigarette atomizer according to claim 1, further comprising an air outlet control structure for controlling the opening and closing of an air outlet channel (100) of the atomizer, wherein the air outlet control structure is linked with the liquid passing control structure; wherein, when the first liquid filling hole (422) is opened under the control of the liquid filling control structure, the air outlet channel (100) is closed under the control of the air outlet control structure; wherein, when the first liquid filling hole (422) is closed under the control of the liquid filling control structure, the air outlet channel (100) is opened under the control of the air outlet control structure.

3. The ultrasonic electronic cigarette atomizer according to claim 2, wherein the air outlet control structure comprises the fixed plate (39) which is disposed in the atomizer housing and fixed on the liquid bin (42), and the slider (36) capable of moves along the length of the fixed plate (39); wherein the slider (36) is provided with an air passing hole (363); wherein, when the slider (36) slides along the fixed plate (39), the slider (36) drives the air passing hole (363) to open or close the air outlet channel (100).

4. The ultrasonic electronic cigarette atomizer according to claim 1, wherein the atomization core comprises an atomization core housing (12), the ultrasonic atomization sheet (1) and the liquid guide structure (60) are both fixed inside the atomization core housing (12), the atomization core extends into the atomizer housing from one side of the atomizer housing, and the atomization core housing (12) is exposed.

5. The ultrasonic electronic cigarette atomizer according to claim 4, wherein the atomization core comprises an atomization seat (4), an atomization sleeve (5), and an atomization cover (13); wherein the atomization sleeve (5) is fixed between the atomization cover (13) and the atomization core housing (12); wherein the ultrasonic atomization sheet (1) is fixed in the atomization seat (4) and the ultrasonic atomization sheet (1) is parallel to the length direction of the electronic cigarette, the atomization seat (4) is sleeved in the atomization sleeve (5), the liquid guide structure (60) comprises liquid storage cotton (6) and a U-shaped liquid guide cotton sheet (7), the liquid storage cotton (6) is fixed in the atomization sleeve (5), both of a first e and a second side of the U-shaped liquid guide cotton sheet (7) pass through the atomization sleeve (5) and are connected with the liquid storage cotton (6), and the first side is opposite to the second side, and an outside of a third side of the shaped liquid guide cotton sheet (7) abuts against the ultrasonic atomization sheet (1); wherein the liquid storage cotton (6) is communicated with the liquid bin (42) through the liquid passing hole (421); wherein the atomization sleeve (5) is provided with an air passing groove (9) for connecting an inside of the third side of the U-shaped liquid guide cotton sheet (7) with an air inlet (301) and a nozzle sleeve (32) on the atomizer housing.

6. The ultrasonic electronic cigarette atomizer according to claim 5, wherein the inside of the third side of the U-shaped liquid guide cotton sheet (7) is communicated with the liquid storage cotton (6) through a cigarette liquid recycling hole (2) on the atomization seat (4).

7. The ultrasonic electronic cigarette atomizer according to claim 5, wherein a positive electrode ring (14) and a negative electrode ring (15) are embedded into the atomization cover (13); wherein one side of the ultrasonic atomization sheet (1) is attached to one end of a positive elastic sheet (16), and the other end of the positive elastic sheet (16) is locked with the positive electrode ring (14) by a positive screw (17); wherein the other side of the ultrasonic atomization sheet (1) is attached to one end of a negative elastic sheet (18), and the other end of the negative elastic sheet (18) is locked with the negative electrode ring (15) by a negative screw (19); wherein a positive elastic electrode (20) attached to the positive electrode ring (14) and a negative elastic electrode (21) attached to the negative electrode ring (15) are arranged in the atomizer housing.

8. The ultrasonic electronic cigarette atomizer according to claim 1, further comprising a locking structure capable of locking and fixing the atomization core; wherein, when the first liquid filling hole (422) is opened under the control of the liquid filling control structure, the atomization core is unlocked under the control of the locking structure; wherein when the first liquid filling hole (422) is closed under the control of the liquid filling control structure, the atomization core is locked and fixed under the control of the locking structure;

wherein the locking structure comprises the fixed plate (39), the slider (36), and a ball-head pin (37) capable of moving up and down along a through hole (392) of the fixed plate (39); wherein the atomization core is provided with a locking hole (8) corresponding to the ball-head pin (37); and wherein the movement of the slider (36) drives the ball-head pin (37) to move up and down to unlock or lock the atomization core.

9. The ultrasonic electronic cigarette atomizer according to claim 8, wherein an external of the hall-head pin (37) is sleeved with a reset spring (38), and a bottom of the reset spring (38) is supported on an inner side wall of the through hole; wherein a bottom of the slider (36) is provided with a bevel of the slider (364) corresponding to the head of the ball-head pin (37).

10. The ultrasonic electronic cigarette atomizer according to claim 8, wherein the atomization core comprises an atomization seat (4), an atomization core inner sleeve (41), an atomization core outer sleeve (48), and an atomization cover (13); wherein the ultrasonic atomization sheet (1) is fixed in the atomization seat (4) and is perpendicular to the length direction of the electronic cigarette, the atomization seat (4) is fixed in a bottom end of the atomization core outer sleeve (48), the liquid guide structure 69 comprises liquid storage cotton (6) and cup-shaped liquid guide cotton (49), the liquid storage cotton (6) is fixed in the atomization core outer sleeve (48), a side wall of the cup-shaped liquid guide cotton (49) is sandwiched between the atomization core outer sleeve (48) and the atomization core inner sleeve (47), the side wall of the cup-shaped liquid guide cotton (49) is connected to the liquid storage cotton (6), and a bottom of the cup-shaped liquid guide cotton (49) abuts against the ultrasonic atomization sheet (1); wherein the liquid storage cotton (6) is communicated with the liquid bin (42); the atomization core inner sleeve (47) and the atomization core outer sleeve (48) are fixed between the atomization cover (13) and the atomization core housing (12); wherein the atomization cover (1) is provided with an air passing groove (9) for connecting an inside of the cup-shaped liquid guide cotton (49) with an air inlet (301) and a nozzle sleeve (32) on the atomizer housing.

11. The ultrasonic electronic cigarette atomizer according to claim 1, wherein the shaft is a liquid retaining plate (401) is disposed at a position of the rotating shaft (40) corresponding to the liquid passing hole (421) the slider (36) can drive the rotating shaft (40) to rotate until the liquid retaining plate (401) is perpendicular to the axis of the liquid passing hole (421) and closes the liquid passing hole (421), and the slider (36) can also drive the rotating shaft (40) to rotate until the liquid retaining plate (401) is parallel to the axis of the liquid passing hole (421) and opens the liquid passing hole (421).

12. The ultrasonic electronic cigarette atomizer according to claim 11, wherein the slider (36) is provided with a rack (365) along the length of the said slider (36), and a gear (402) engaging with the rack (365) is disposed on the rotating shaft (40).

13. The ultrasonic electronic cigarette atomizer according to claim 1, wherein the shaft is a sliding shaft (50); the slider (36) can drive the sliding shaft (50) to slide up and down along the receiving groove (423) and to open or close the liquid passing hole (421).

14. The ultrasonic electronic cigarette atomizer according to claim 13, wherein a bottom of the slider (36) is provided with a first bevel (362), a top of the sliding shaft (50) is provided with a second bevel (501) corresponding to the first bevel (362), an external of the sliding shaft (50) is sleeved with a return spring (51), the sliding shaft (50) is provided with a limiting portion (502), a, bottom end of the return spring (51) is supported on a step of thein inner side wall of the receiving groove (423), and a top end of the return spring (51) abuts against the limiting portion (502).

15. The ultrasonic electronic cigarette atomizer according to claim 13, wherein a vertical guiding groove (424) is formed in an inner side wall of the receiving groove (423), and the sliding shaft (50) is provided with a guiding salient point (503) matching the vertical guiding groove (424).

16. The ultrasonic electronic cigarette atomizer according to claim 1, wherein a silicone pad (25) is disposed in the second liquid filling hole (391), the silicone pad (25) is provided with raised ribs (252) on a side facing the slider (36), and the center of the silicone pad (25) is provided with a fourth liquid filling hole (251) opposite to the second liquid filling hole (391).

17. The ultrasonic electronic cigarette atomizer according to claim 16, wherein an elastic sheet (253) is disposed in the fourth liquid filling hole (251), and the elastic sheet (253) is unilaterally connected to the silicone pad (25).

18. The ultrasonic electronic cigarette atomizer according to claim 1, wherein a cigarette liquid recycling groove (3) is formed between an atomization region of the ultrasonic atomization sheet (1) and the liquid guide structure (60).

19. The ultrasonic electronic cigarette atomizer according to claim 18, wherein the atomization core comprises are atomization seat (4) and an atomization sleeve (5), the ultrasonic atomization sheet (1) is fixed in the atomization seat (4), the atomization seat (4) is sleeved in the atomization sleeve (5), the liquid guide structure (60) comprises a porous liquid guide body (11), the porous liquid guide body (11) is embedded in the atomization seat (4), an outer end face of the porous liquid guide body (11) is communicated with the liquid bin (42) of the electronic cigarette, and an inner end face of the porous liquid guide body (11) abuts against the ultrasonic atomization sheet (1); wherein the cigarette liquid recycling groove (3) is disposed in the inner end face of the porous liquid guide body (11).

* * * * *